US005998725A

United States Patent [19]

Ohta

[11] Patent Number: 5,998,725

[45] Date of Patent: Dec. 7, 1999

[54] MUSICAL SOUND SYNTHESIZER AND STORAGE MEDIUM THEREFOR

[75] Inventor: Shinichi Ohta, Hamamatsu, Japan

[73] Assignee: Yamaha Corporation, Hamamatsu, Japan

[21] Appl. No.: 08/902,424

[22] Filed: Jul. 29, 1997

[30] Foreign Application Priority Data

Jul. 23, 1996 [JP] Japan ..... 8-202165
Jul. 31, 1996 [JP] Japan ..... 8-217965

[51] Int. Cl.[6] ..... G10L 5/00; G10L 5/02; G10L 5/04

[52] U.S. Cl. ..... 84/627; 84/609; 84/616; 84/622; 84/623; 84/649; 84/654; 84/659

[58] Field of Search ..... 84/602–606, 609–610, 84/616, 607, 622–625, 627, 634, 649–650, 654, 659–660, 663; 364/723, 724.1; 704/258, 267

[56] References Cited

U.S. PATENT DOCUMENTS 4,527,274 7/1985 Gaynor .
4,916,996 4/1990 Suzuki et al. ..... 84/603
4,979,216 12/1990 Malsheen et al. .
5,235,124 8/1993 Okamura et al. ..... 84/601
5,321,794 6/1994 Tamura ..... 395/269
5,642,470 6/1997 Yamamoto et al. ..... 395/2.79
5,682,502 10/1997 Ohtsuka et al. ..... 395/2.76
5,703,311 12/1997 Ohta ..... 84/622
5,715,363 2/1998 Tamura et al. ..... 395/2.14
5,747,715 5/1998 Ohta et al. ..... 84/609

FOREIGN PATENT DOCUMENTS 3-200300 2/1991 Japan .
4-251297 2/1992 Japan .

*Primary Examiner*—Robert E. Nappi
*Assistant Examiner*—Marlon T. Fletcher
*Attorney, Agent, or Firm*—Graham & James LLP

[57] ABSTRACT

A musical sound synthesizer generates a predetermined singing sound based on performance data. A compression device determines whether each of a plurality of phonemes forming the predetermined singing sound is a first phoneme to be sounded in accordance with a note-on signal indicative of a note-on of the performance data, and compresses a rise time of the first phoneme when the first phoneme is sounded in accordance with occurrence of the note-on signal of the performance data.

18 Claims, 27 Drawing Sheets

FIG.3

| TIME | MIDI SIGNAL | MEANING |
|---|---|---|
| $t_1$ | F0 43 1n 7F 03 | SYS_EX START, phoneSEQ HEADER |
| | 35 0A | s,50ms |
| | 20 00 | a,INDEFINITE |
| | F7 | SYS_EX END |
| $t_2$ | 90 30 42 | NOTE ON,C3,42 |
| $t_3$ | 90 30 00 | NOTE OFF,C3 |
| $t_4$ | F0 43 1n 7F 03 | SYS_EX START, phoneSEQ HEADER |
| | 22 00 | i,INDEFINITE |
| | F7 | SYS_EX END |
| $t_5$ | 90 34 50 | NOTE ON,E3,50 |
| $t_6$ | 90 34 00 | NOTE OFF,E3 |
| $t_7$ | F0 43 1n 7F 03 | SYS_EX START, phoneSEQ HEADER |
| | 3F 01 | CL,5ms |
| | 37 02 | t,10ms |
| | 20 00 | a,INDEFINTE |
| | F7 | SYS_EX END |
| $t_8$ | 90 37 46 | NOTE ON,G3,46 |
| $t_9$ | 90 37 00 | NOTE OFF,G3 |

*FIG.12A*

| PHPAR[*] |
| --- |
| VF FREQ1 |
| VF FREQ2 |
| VF FREQ3 |
| VF FREQ4 |
| UF FREQ1 |
| UF FREQ2 |
| UF FREQ3 |
| UF FREQ4 |
| VF LEVEL1 |
| VF LEVEL2 |
| VF LEVEL3 |
| VF LEVEL4 |
| UF LEVEL1 |
| UF LEVEL2 |
| UF LEVEL3 |
| UF LEVEL4 |
| FSHAPE |

*FIG.12B*

| PHCOMB[1-2] |
| --- |
| VF LEVEL CURVE1 |
| VF LEVEL CURVE1 |
| VF FREQ CURVE2 |
| VF FREQ CURVE2 |
| VF LEVEL CURVE2 |
| VF LEVEL CURVE2 |
| VF INIT FREQ1 |
| VF INIT FREQ2 |
| VF INIT FREQ3 |
| VF INIT FREQ4 |
| UF INIT FREQ1 |
| UF INIT FREQ2 |
| UF INIT FREQ3 |
| UF INIT FREQ4 |
| COMBI TIME |
| RCG TIME |

1201
KEY-ON
TGCH#1
"i"
1202
KEY-OFF
"ta"

LEVEL
VTG
1211
1212
1214
TIME

LEVEL
UTG
1213
TIME

FORMANT FREQUENCY
1215

LEVEL
1120
TIME

MUSICAL SOUND SYNTHESIZER AND STORAGE MEDIUM THEREFOR

BACKGROUND OF THE INVENTION

1. Field of the Invention

This invention relates to a musical sound synthesizer for synthesizing a musical sound having desired formants and a storage medium storing a program for synthesizing such a musical sound.

2. Prior Art

It is generally known that a sound generated by a natural musical instrument has formants peculiar to its own structure, such as the configuration of a sound-board in the case of a piano. A human voice also has peculiar formants determined by the shapes of related organs of the human body, such as the vocal cord, the vocal tract, and the oral cavity, and the formants characterize a timbre peculiar to the human voice.

To simulate the timbre of a natural musical instrument or a human vocal sound (singing sound) by an electronic musical instrument, a musical sound must be synthesized in accordance with formants peculiar to the timbre. An apparatus for synthesizing a sound having desired formants has been proposed e.g. by Japanese Laid-Open Patent Publication (Kokai) No. 3-200300 and Japanese Laid-Open Patent Publication (Kokai) No. 4-251297.

FIG. 1 shows an example of the arrangement of a musical sound synthesizer for synthesizing a vocal sound having such desired formants. In the synthesizer, performance information 1311 and lyrics information 1312 are input to a CPU 1301 e.g. as messages in MIDI (Musical Instrument Digital Interface) format. The performance information 1311 includes a note-on message and a note-off message each including pitch information. The lyrics information 1312 is a message designating an element of lyrics (phoneme data) of a song which is to be sounded according to a musical note designated by the performance information 1311. The lyrics information 1312 is provided as a system exclusive message in MIDI format. For instance, when elements of lyrics "さいた" (Japanese word meaning "bloomed")which can be expressed by phonemes "saita" are synthesized at pitches of C3, E3, and G3, the performance information 1311 and the lyrics information 1312 are input to a CPU 1301 of the apparatus e.g. in the following sequence (1):

s<20>a<0> note-on C3 note-off C3 i<0> note-on E3 note-off E3 t<02>a<00> note-on G3 note-off G3 (1)

It should be noted that according to this method, data of an element of lyrics to be sounded is sent to the CPU 1301 prior to a note-on message according to which the element of lyrics is sounded. In the above sequence of messages, "s","a","i",and "t" represent phonemes, and the numerical value within < > following each of the phonemes represents the duration of the phoneme. <0>, however, designates that the sounding of the phoneme should be maintained until a note-on message for the following phoneme is received.

As the CPU 1301 receives the above sequence (1) of MIDI messages, it operates in the following manner: First, when data of an element of lyrics to be sounded "s<20>a<0>" is received, the data is stored in a lyrics information buffer 1305. Then, when a message "note-on C3" is received, the CPU 1301 obtains information of the lyrics element "s<20>a<0>" from the lyrics information buffer 1305, calculates formant parameters for generating a sound of the lyrics element at the designated pitch C3 and supplies the same to a (voiced sound/unvoiced sound) formant-synthesizing tone generator 1302. The CPU 1301 subsequently receives a message "note-off C3",but in the present case, "a<0>" has already been designated, and therefore, the CPU ignores the received message "note-on C3" to maintain the sounding of the phoneme "a" until the following note-on message is received. It should be noted, however, when the phonemes "sa" and the phoneme "i" are to be sounded separately, the CPU 1301 delivers data "note-off C3" to the formant-synthesizing tone generator 1302 to stop sounding of the phonemes "sa" at the pitch C3. Then, when data of an lyrics element "i<0>" to be sounded is received, the data (lyrics data) is stored in the lyrics information buffer 1305, and when a message "note-on E3" is received, the CPU 1301 obtains information of the lyrics element "i<0>" to be sounded from the lyrics information buffer 1305, and calculates formant parameters for generating a vocal sound of the lyrics element at the designated pitch "E3" to send the calculated formant parameters to the formant-synthesizing tone generator 1302. Thereafter, musical sounds of phonemes "ta" are generated in the same manner.

The formant parameters are time sequence data, and transferred from the CPU 1301 to the formant-synthesizing tone generator 1302 at predetermined time intervals. The predetermined time intervals are generally set to such a low rate of several milliseconds as to generate tones having features of a human voice. By successively changing the formants at the predetermined time intervals, musical sounds having features of a human vocal sound are generated. The formant parameters include a parameter for differentiation between a voiced sound and an unvoiced sound, a formant center frequency, a formant level, a formant bandwidth, etc. In FIG. 1, reference numeral 1303 designates a program memory storing control programs executed by the CPU 1301, and 1304 a working memory for temporarily storing various kinds of working data.

To generate performance data for a musical piece provided with lyrics to be played by the musical sound synthesizer constructed as above, it is required to set timing for starting each instrument sound or singing sound, duration of the same, etc. according to a musical note.

However, in general, a human vocal sound is slow to rise in its level compared with an instrument sound, and therefore, there is a discrepancy in timing between a start of generation of a human vocal sound designated by performance data and a start of generation of the same actually sensed by the hearing. For instance, even if an instrument sound and a singing sound are generated simultaneously in response to a note-on signal for the instrument sound, it is sensed by the hearing as if the singing sound started with a slight delay with respect to the instrument sound.

As a specific example, let it be assumed that based on data of a musical piece which is comprised of melody data having a timbre which rises relatively quickly, e.g. a timbre of piano, input by keyboard performance, i.e. playing the piano, and accompaniment part data prepared in a manner corresponding to the melody data, automatic performance is carried out with lyrics assigned to the melody data and a synthesized human voice as a singing part controlled to sound the melody instead of the piano, while sounding the accompaniment part data. Then, one will most probably feel that the singing part (human voice sound) which is slow in rise time and the accompaniment part are conspicuously out of time with each other.

This problem can be overcome by adjusting the timing of performance data of the entire musical piece or each performance part, which is, however, very troublesome.

Further, when the conventional musical sound synthesizer generates a human vocal sound or the like, there is a problem that consecutive phonemes are not sounded in a properly coarticulated manner (particularly in transition from a voiced sound to an unvoiced sound), which results in an unnatural sound.

SUMMARY OF THE INVENTION

It is a first object of the invention to make it possible to synthesize vocal sounds, such as singing sounds, at suitable timing for making the vocal sounds harmonious with instrument sounds, in a simple manner.

It is a second object of the invention to make it possible to properly control coarticulation between phonemes of vocal sounds, such as singing sounds in sounding them, so that the vocal sounds generated are natural.

To attain the first object, according to a first aspect of the invention, there is provided a musical sound synthesizer for generating a predetermined singing sound based on performance data, comprising a compression device that determines whether each of a plurality of phonemes forming the predetermined singing sound is a first phoneme to be sounded in accordance with a note-on signal indicative of a note-on of the performance data, and compresses a rise time of the first phoneme when the first phoneme is sounded in accordance with occurrence of the note-on signal of the performance data.

Preferably, the note-on signal of the performance data is a note-on signal indicative of a note-on of an instrument sound.

To attain the first object, according to a second object of the invention, there is provided a musical sound synthesizer for generating a predetermined singing sound based on performance data, comprising a storage device that stores a rise time of each of a plurality of phonemes forming the singing sound and a rise characteristic of the each of the phonemes within the rise time, a first determining device that determines whether or not the rise time of the each of the phonemes is equal to or shorter than a sounding duration time assigned to the each of the phonemes when the each of the phonemes is to be sounded, a second determining device that determines whether or not the each of the phonemes is a first phoneme to be sounded in accordance with a note-on signal indicative of a note-on of the performance data, and a compression device that compresses the rise characteristic of the each of the phonemes along a time axis, based on results of the determinations of the first determining device and the second determining device.

Preferably, the note-on signal of the performance data is a note-on signal indicative of a note-on of an instrument sound.

Preferably, when the first determining device determines that the rise time of the each of the phonemes is equal to or shorter than the sounding duration time assigned to the each of the phoneme, the compression device sets the rise time to the sounding duration time.

Preferably, the compression device compresses the rise characteristic of the each of the phonemes along the time axis when the second determining device determines that the each of the phonemes is the first phoneme to be sounded in accordance with the note-on signal of the performance data.

To attain the first object, according to a third aspect of the invention, there is provided a musical sound synthesizer for generating a predetermined singing sound based on performance data, comprising a storage device that stores a plurality of phonemes forming the predetermined singing sound, and a sounding duration time assigned to the each of the phonemes, a sounding-continuing device that, when the storage device stores a predetermined value indicative of a sounding duration time assigned to a last phoneme of the phonemes, which is to be sounded last, causes the last phoneme of the phonemes to continue to be sounded until a note-signal indicative of a note-on of the performance data is generated next time, and a sounding-interrupting device that, when the plurality of phonemes include an intermediate phoneme other than the last phoneme, to which the predetermined value is assigned as the sounding duration time stored in the storage device, stops sounding of the intermediate phoneme in accordance with occurrence of a note-off signal indicative of a note-off of the performance data, and thereafter causes a phoneme following the intermediate phoneme to be sounded.

To attain the first object, according to a fourth aspect of the invention, there is provided a machine readable storage medium containing instructions for causing the machine to perform a musical sound synthesizing method of generating a predetermined singing sound based on performance data, the method comprising the steps of determining whether each of a plurality of phonemes forming the predetermined singing sound is a first phoneme to be sounded in accordance with a note-on signal indicative of a note-on of the performance data, compressing a rise time of the first phoneme when the first phoneme is sounded in accordance with occurrence of the note-on signal of the performance data.

To attain the second object, according to a fifth aspect of the invention, there is provided a musical sound synthesizer comprising a plurality of tone generator channels to which are input formant parameters externally supplied at time intervals longer than a sampling repetition period, the tone generator channels generating a voiced sound waveform and an unvoiced sound waveform having formants formed based on the formant parameters and outputting the voiced sound waveform and the unvoiced sound waveform at the sampling repetition time period, an envelope generator that forms an envelope waveform and outputs the envelope waveform at the sampling repetition period, a detecting device that detects whether switching of phonemes to be sounded is to be carried out between phonemes of voiced sounds or between phonemes of unvoiced sounds, and a control device that generates a musical sound according to the formant parameters supplied at the time intervals by the-use of ones of the tone generator channels used before the switching of phonemes to be sounded, when the detecting device detects that the switching of phonemes to be sounded is to be carried out between the phonemes of voiced sounds or between the phonemes of unvoiced sounds, the control device decreasing formant levels of the formant parameters of a preceding one of the phonemes to be sounded by the use of the envelope waveform output from the envelope generator at the sampling repetition period to generate a sound of a following one of the phonemes to be sounded, by switching over the tone generator channels, when the detecting device detects that the switching of the phonemes to be sounded is to be carried out between phonemes other than the phonemes of voiced sounds or the phonemes of unvoiced sounds and at the same time the formant levels of the formant parameters of the preceding one of the phonemes to be sounded are to be decreased in a short time period depending on relationship between the preceding one of the phonemes to be sounded and the following one of the phonemes to be sounded.

To attain the second object, according to a sixth aspect of the invention, there is provided a musical sound synthesizer comprising a plurality of tone generator channels to which are input formant parameters externally supplied at time intervals longer than a sampling repetition period, the tone generator channels generating a voiced sound waveform and an unvoiced sound waveform having formants formed based on the formant parameters and outputting the voiced sound waveform and the unvoiced sound waveform at the sampling repetition time period, an envelope generator that forms an envelope waveform and outputs the envelope waveform at the sampling repetition period, a detecting device that detects whether switching of phonemes to be sounded is to be carried out between phonemes of voiced sounds or between phonemes of unvoiced sounds, and a control device that shifts a phoneme to be sounded from a preceding one of the phonemes to be sounded to a following one of the phonemes to be sounded by inputting formant parameters obtained by interpolating the formant parameters between the preceding one of the phonemes to be sounded and the following one of the phonemes to be sounded, at the time intervals, to identical ones of the tone generator channels with ones used for sounding the preceding one of the phonemes to be sounded, when the detecting device detects that the switching of the phonemes to be sounded is to be carried out between the phonemes of voiced sounds or between the phonemes of unvoiced sounds, the control device decreasing formant levels of the formant parameters of the preceding one of the phonemes to be sounded by the use of the envelope waveform output from the envelope generator at the sampling repetition period, and starting sounding the following one of the phonemes to be sounded by the use of other ones of the tone generator channels than the ones used for sounding the preceding one of the phonemes to be sounded, when the detecting device detects that the switching of the phonemes to be sounded is to be carried out between phonemes other than the phonemes of voiced sounds or the phonemes of unvoiced sounds and at the same time the formant levels of the formant parameters of the preceding one of the phonemes to be sounded are to be decreased in a short time period depending on relationship between the preceding one of the phonemes to be sounded and the following one of the phonemes to be sounded.

To attain the second object, according to a seventh aspect of the invention, there is provided a musical sound synthesizer comprising a formant parameter-sending device that sends formant parameters at time intervals longer than a sampling repetition time period, the formant parameter-sending device having a function of interpolating the formant parameters between a preceding one of phonemes to be sounded and a following one of the phonemes to be sounded and sending the formant parameters obtained by the interpolation a plurality of tone generator channels that generate a voiced sound waveform and an unvoiced sound waveform having formants formed based on the formant parameters sent from the formant parameter-sending device, and output the voiced sound waveform and the unvoiced sound waveform at the sampling repetition time period an envelope generator that forms an envelope waveform and outputs the envelope waveform at the sampling repetition period a detecting device that detects whether switching of the phonemes to be sounded is to be carried out between phonemes of voiced sounds or between phonemes of unvoiced sounds, and a control device that shifts a phoneme to be sounded from the preceding one of the phonemes to be sounded to the following one of the phonemes to be sounded by causing the formant parameter-sending device to send the formant parameters obtained by the interpolation between the preceding one of the phonemes to be sounded and the following one of the phonemes to be sounded, to the tone generator channels at the time intervals, when the detecting device detects that the switching of the phonemes to be sounded is to be carried out between the phonemes of voiced sounds or between the phonemes of unvoiced sounds, the control device decreasing formant levels of the formant parameters of the preceding one of the phonemes to be sounded by the use of the envelope waveform output from the envelope generator at the sampling repetition period, and starting sounding the following one of the phonemes to be sounded by the use of other ones of the tone generator channels than ones used for sounding the preceding one of the phonemes to be sounded, when the detecting device detects that the switching of the phonemes to be sounded is to be carried out between phonemes other than the phonemes of voiced sounds or the phonemes of unvoiced sounds and at the same time the formant levels of the formant parameters of the preceding one of the phonemes to be sounded are to be decreased in a short time period depending on relationship between the preceding one of the phonemes to be sounded and the following one of the phonemes to be sounded.

To attain the second object, according to an eighth aspect of the invention, there is provided a musical sound synthesizer comprising a formant parameter-sending device that sends formant parameters at time intervals longer than a sampling repetition time period, the formant parameter-sending device having a function of interpolating the formant parameters between a preceding one of phonemes to be sounded and a following one of the phonemes to be sounded and sending the formant parameters obtained by the interpolation, a plurality of first tone generator channels that generate a voiced sound waveform having formants formed based on the formant parameters sent from the formant parameter-sending device and output the voiced sound waveform at the sampling repetition time period, an envelope generator that forms an envelope waveform which rises from a level of 0 to a level of 1 in accordance with a key-on signal, holds the level of 1 during the key-on, and falls at a predetermined release rate in accordance with a key-off signal, and outputs the envelope waveform at the sampling repetition period, a formant level control device that controls formant levels of the voiced sound waveform output from the first tone generator channels, based on the envelope waveform output from the envelope generator and formant levels of the formant parameters sent from the formant parameter-sending device, a plurality of second tone generator channels that generate an unvoiced sound waveform having formants formed based on the formant parameters sent from the formant parameter-sending device and output the unvoiced sound waveform at the sampling repetition time period, a mixing device that mixes the voiced sound waveform controlled in respect of the formant levels by the formant level control device and the unvoiced sound waveform output from the second tone generator channels, a detecting device that detects whether switching of the phonemes to be sounded is to be carried out between phonemes of voiced sounds or between phonemes of unvoiced sounds, and a control device that (i) shifts a phoneme to be sounded from the preceding one of the phonemes to be sounded to the following one of the phonemes to be sounded by using ones of the first or second tone generator channels used for sounding the preceding phoneme of the phonemes to be sounded and causing the formant parameter-sending device to send the formant parameters obtained by the interpolation between the preceding one of the phonemes to be sounded and the following one of the phonemes to be sounded, to the ones of the first or second tone generator channels at the time intervals, when the detecting device detects that the switching of the phonemes to be sounded is to be carried out between the phonemes of voiced sounds or between the phonemes of unvoiced sounds, and (ii) sends the key-off signal for the preceding one of the phonemes to be sounded to thereby decrease a formant level of each of the formants of the voiced sound waveform output from ones of the first tone generator channels used for sounding the preceding one of the phonemes to be sounded, by the use of the envelope waveform output from the envelope generator at the sampling repetition period, and at the same time starts sounding the following one of the phonemes to be sounded by the use of other ones of the first tone generator channels than ones used for sounding the preceding one of the phonemes to be sounded, when the detecting device detects that the switching of the phonemes to be sounded is to be carried out from a phoneme of a voiced sound to a phoneme of an unvoiced sound.

To attain the second object, according to a ninth aspect of the invention, there is provided a musical sound synthesizer comprising a formant parameter-sending device that sends formant parameters at first time intervals longer than a sampling repetition time period, the formant parameter-sending device having a function of interpolating the formant parameters between a preceding one of phonemes to be sounded and a following one of phonemes to be sounded and sending the formant parameters obtained by the interpolation, a formant level-sending device that sends only formant levels out of the formant parameters at second time intervals shorter than the first time intervals, a plurality of tone generator channels that generate a voiced sound waveform and an unvoiced sound waveform each having formants formed based on the formant parameters sent from the formant parameter-sending device at the first time intervals, and output the voiced sound waveform and the unvoiced sound waveform, the tone generator channels generating a waveform having formant levels thereof controlled by the formant levels sent from the formant level-sending device at the second time intervals and outputting the waveform, a detecting device that detects whether switching of phonemes to be sounded is to be carried out between phonemes of voiced sounds or between phonemes of unvoiced sounds, and a control device that (i) shifts a phoneme to be sounded from the preceding one of the phonemes to be sounded to the following one of the phonemes to be sounded by using ones of the tone generator channels used for sounding the preceding phoneme of the phonemes to be sounded and causing the formant parameter-sending device to send the formant parameters obtained by the interpolation between the preceding one of the phonemes to be sounded and the following one of the phonemes to be sounded, to the ones of the tone generator channels at the first time intervals, when the detecting device detects that the switching of the phonemes to be sounded is to be carried out between the phonemes of voiced sounds or between the phonemes of unvoiced sounds, and (ii) causes the formant level-sending device to send formant levels which quickly and smoothly fall at the second time intervals, to thereby decrease the formant levels of the preceding one of the phonemes to be sounded, when the detecting device detects that switching of the phonemes to be sounded is to be carried out between phonemes other than the phonemes of voiced sounds or the phonemes of unvoiced sounds and at the same time the formant levels of the formant parameters of the preceding one of the phonemes to be sounded are to be decreased, in a short time period depending on relationship between the preceding one of the phonemes to be sounded and the following one of the phonemes to be sounded, and at the same time starts sounding the following one of the phonemes to be sounded by the use of other ones of the tone generator channels than the ones of the tone generator channels used for sounding the preceding one of the phonemes to be sounded.

To attain the second object, according to a tenth aspect of the invention, there is provided a machine readable storage medium containing instructions for causing said machine to perform a musical sound synthesizing method of synthesizing a musical sound by the use of a plurality of tone generator channels to which are input formant parameters externally supplied at time intervals longer than a sampling repetition period, said tone generator channels generating a voiced sound waveform and an unvoiced sound waveform having formants formed based on said formant parameters and outputting said voiced sound waveform and said unvoiced sound waveform at said sampling repetition time period, said method comprising the steps of forming an envelope waveform and outputting said envelope waveform at said sampling repetition period, detecting whether switching of phonemes to be sounded is to be carried out between phonemes of voiced sounds or between phonemes of unvoiced sounds, and generating a musical sound according to said formant parameters supplied at said time intervals by the use of ones of said tone generator channels used before said switching of phonemes to be sounded, when it is detected that said switching of phonemes to be sounded is to be carried out between said phonemes of voiced sounds or between said phonemes of unvoiced sounds, and decreasing formant levels of said formant parameters of a preceding one of said phonemes to be sounded by the use of said envelope waveform output at said sampling repetition period to generate a sound of a following one of said phonemes to be sounded by switching over said tone generator channels, when it is detected that said switching of said phonemes to be sounded is to be carried out between phonemes other than said phonemes of voiced sounds or said phonemes of unvoiced sounds and at the same time said formant levels of said formant parameters of said preceding one of said phonemes to be sounded is to be decreased in a short time period depending on relationship between said preceding one of said phonemes to be sounded and said following one of said phonemes to be sounded.

The above and other objects, features, and advantages of the invention will become more apparent from the following detailed description taken in conjunction with the accompanying drawings.

BRIEF DESCRIPTION OF THE DRAWINGS

FIG. 3 is a diagram showing an example of a format of MIDI signals supplied to the electronic musical instrument of FIG. 2;

FIGS. 12A to 12D are diagrams showing data formats of parameters stored in a data base;

DETAILED DESCRIPTION

The invention will now be described with reference to the drawings showing embodiments thereof.

Figure 1:
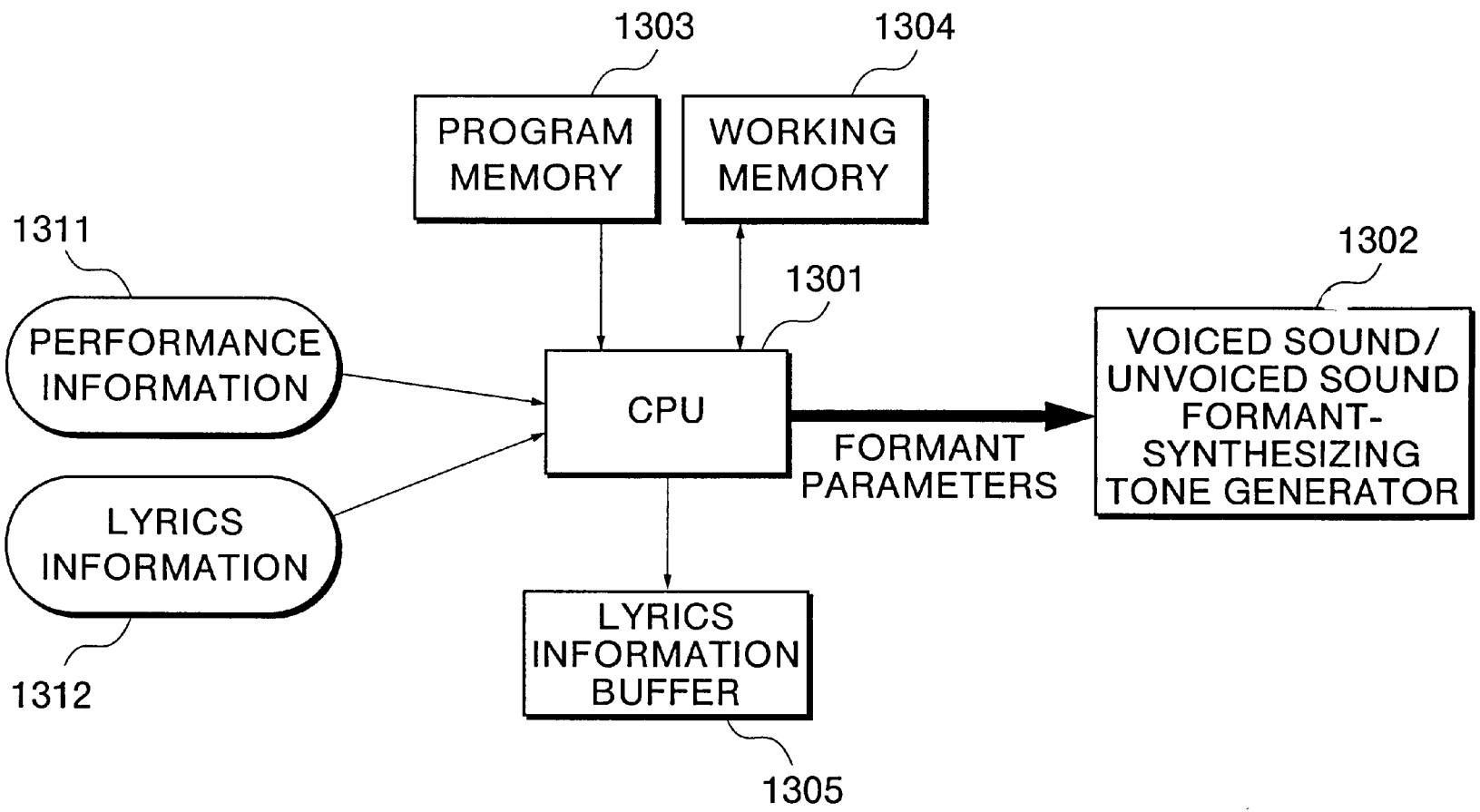
FIG.1 PRIOR ART
FIG. 1 is a block diagram showing the arrangement of a conventional musical sound synthesizer.

First, an electronic musical instrument incorporating a musical sound synthesizer according to a first embodiment of the invention will be described. Referring to FIG. 3, description will be made of signals in MIDI format (MIDI signals) supplied to the electronic musical instrument. In the illustrated example, similarly to the FIG. 1 prior art, it is assumed that a musical sound is generated at pitches corresponding to notes C3 (do), E3 (me) and G3 (so) together with respective elements of lyrics of a song "sa", "i" and "ta".

Of the MIDI signals, ones related to instrument sounds will be described first. In FIG. 3, a column "TIME" designates time points at which MIDI signals are input through a MIDI interface 3 (see FIG. 2). For instance, at a time point $t_2$, a MIDI signal containing data '90', '30' and '42' is supplied to the MIDI interface. It should be noted that throughout the specification, characters including numbers which are quoted by a single quotation mark represent a hexadecimal number.

The data '90' of the MIDI signal designates a note-on, data '30' a note number "C3", and data '42' a velocity. That is, the MIDI signal received at the time point $t_2$ is a message meaning "Note on a sound at a pitch corresponding to a note C3 at a velocity '42'".

At the following time point $t_3$, another MIDI signal containing data '90', '30' and '00' is supplied. As mentioned above, the data '90' designates a note-on. However, in an exceptional case of data of the velocity being equal to '00', the data '90' means a note-off. In short, the MIDI signal received at the time point $t_3$ means "Note off the sound at the pitch corresponding to the note C3".

Similarly, at a time point $t_5$, a note-on message on a note number '34' ("E3")at a velocity '50' is supplied, and at a time point $t_6$, a note-off message corresponding to this note-on message is supplied. Further, at a time point $t_8$, a note-on message on a note number '37' ("G3")at a velocity '46' is supplied, and at a time point $t_9$, a note-off message corresponding to this note-on message is supplied.

Thus, the MIDI signals shown in FIG. 3 give instructions for generating the sound of "C3" over a time period $t_2$ to $t_3$. However, it is also required to designate a singing sound (element of lyrics), i.e. "さ" ("sa" in Japanese) to be generated in synchronism with the instrument sound of "C3". In the present embodiment, such designation can be carried out at a desired time point before note-on (at the time point $t_2$ in the present case) of an instrument sound. In the illustrated example, it is assumed that the element of lyrics ("sa")is designated at a time point $t_1$.

A first MIDI signal supplied at the time point $t_1$ is a message containing data 'F0'. This message designates start of information called "system exclusive" according to the MIDI standard. The system exclusive is information for transferring data of vocal sounds after appearance of the message containing data 'F0' until appearance of a message containing data 'F7'. Details of the system exclusive can be freely defined by a registered vender or maker of MIDI devices.

In the present embodiment, data of vocal sounds, such as singing sounds, are transferred by the use of the system exclusive. Hereafter, such data of vocal sounds will be called "phone sequence data". The system exclusive is also used for various purposes other than transfer of the phone sequence data. Therefore, in the present embodiment, if the data 'F0' is followed by data '43', '1n', '7F' and '03' (where "n" represents a desired number of one digit), it is determined that the system exclusive is for the phone sequence data. Hereafter, the data sequence '43' '1n' '7F' '03' will be called "the phone sequence header".

A MIDI signal containing data '35' following the phone sequence header designates a phoneme "s". More specifically, the singing sound "sa" to be generated can be decomposed into phonemes of "s" and "a",and hence the sounding of the phoneme "s" is first designated by the above data. Data (except '00') following each phoneme represents the duration of the phoneme in units of 5 milliseconds In the illustrated example, the duration is designated as 'OA' (which is equal to "10" in the decimal system), which means that "50 milliseconds" is designated for the duration of the phoneme "s". The following MIDI signal designates a phoneme "a" by data '20', and the duration of the same by data '00'.

When the duration of '00' is designated, it means "Maintain the present sounding until the following note-on message is supplied". Therefore, in the illustrated example, the sounding of the phoneme "a" is continued until a note-on event of a sound "E3" occurs at the time point $t_5$.

The reason for designating such an indefinite duration for the phoneme (until the following note-on message) by the data '00' is that while instrument sounds tend to be generated in a discontinued manner, elements of lyrics tend to be sounded in a continuous manner. It goes without saying that when a vocal sound of an element of lyrics, (phoneme "a" in the present case) should be generated in a manner separate from the following vocal sound, a desired value can be designated for the duration in place of '00'.

Then, it is required to designate a singing sound to be generated in synchronism with the sound of "E3" i.e. "い" ("i" in Japanese). In the present embodiment, such designation can be carried out at a desired time point before a time point of note-on of the instrument sound "E3" (time point $t_5$ in the present case) but after the time point ($t_1$) at which the immediately preceding singing sound was designated. In the illustrated example, it is assumed that the element of the lyrics ("sa")is designated at a time point $t_4$. At the time point, accordingly, the message containing the data 'F0' for starting the system exclusive and the data sequence of the phone sequence header '43' '1n' '7F' '03' is again supplied.

Then, a message containing data '22' indicative of a phoneme "i" is supplied. That is, an element of the lyrics "い" in Japanese is expressed by a single phoneme "i",and hence the sounding of the single phoneme is designated. The phoneme data is followed by data '00', whereby it is instructed that the sounding of the phoneme "i" should be continued until the following note-on event occurs, i.e. until a time point $t_8$.

Then, a singing sound to be generated in synchronism with the instrument sound of "G3",i.e. an element of the lyrics "た" ("ta" in Japanese) can be designated at a desired time point before the time point ($t_8$) of note-on of the instrument sound but after the time point ($t_4$) of designation of generation of the immediately preceding singing sound. In the illustrated example, it is assumed that the element of lyrics ("ta")is designated at a time point $t_7$. At the time point $t_1$, accordingly, the message containing the data 'F0' for starting the system exclusive and the data sequence of the phone sequence header '43' '1n' '7F' '03' is again supplied.

Then, a message containing data "3F" and '01' is supplied. The data "3F" represents a closing sound "CL" which means "Interrupt the sounding a moment". More specifically, the element of the lyrics or Japanese syllable "た" ("ta")does not purely consist of two phonemes "t" and "a",but normally includes a pause inserted before the sounding of the phoneme "t" which is caused by applying the bottom of the tongue to the upper and lower incisor teeth to block the flow of air. To provide this pause, the closing sound "CL" is designated as the first or preliminary phoneme to be generated over 5 milliseconds Data "37" of the following message containing data "37" and data "02" represents the phoneme "t", while data '20' of the message containing data '20' and '00' represents the phoneme "am, as mentioned above.

As described in detail above, MIDI signals supplied to the electronic musical instrument of the present embodiment specify contents of a singing sound to be generated, by means of phone sequence data, in advance, and then designate generation of both an instrument sound and the singing sound synchronous therewith by a subsequent note-on signal indicative of the instrument sound.

In the present embodiment, a tone generator similar to one disclosed in Japanese Laid-Open Patent Publication (Kokai) No. 3-200300 is employed. This tone generator has eight channels assigned to singing sounds to be generated, four of which are used for synthesizing first to fourth formants of each voiced sound and the remaining four for synthesizing first to fourth formants of each unvoiced sound.

Formant levels of the first to fourth formants of the unvoiced sound (referred to hereinafter as "unvoiced sound first formant level to fourth formant level")are designated by UTG1 to UTG4 and formant frequencies of the same (referred to hereinafter as "unvoiced sound first formant frequency to fourth formant frequency")by UTGf1 to UTGf4, respectively, while formant levels of the first to fourth formants of the voiced sound (referred to hereinafter as "voiced sound first formant level to fourth formant level")are designated by VTG1 to VTG4 and formant frequencies of the same (referred to hereinafter as "voiced sound first formant frequency to fourth formant frequency") by VTGf1 to VTGf4, respectively.

In the present specification, characteristics of each phoneme in a steady state are expressed by a parameter set PHPAR[*], where the symbol "*" represents the name of each phoneme, such as "s","a" and "i". Details of the parameter set PHPAR[*] are shown in FIG. 12A. As shown in the figure, the parameter set PHPAR[*] includes formant center frequencies VF FREQ1 to VF FREQ4 of the first to fourth formants of a voiced sound (referred to hereinafter as "voiced sound first formant center frequency to fourth formant center frequency VF FREQ1 to VF FREQ4"), formant center frequencies UF FREQ1 to UF FREQ4 of the first to fourth formants of an unvoiced sound (referred to hereinafter as "unvoiced sound first formant center frequency to fourth formant center frequency UF FREQ1 to UF FREQ4"), formant levels VF LEVEL1 to VF LEVEL4 of the first to fourth formants of the voiced sound (referred to hereinafter as "voiced sound first formant level to fourth formant level VF LEVEL1 to VF LEVEL4"), formant levels UF LEVEL1 to UF LEVEL4 of the first to fourth formants of the unvoiced sound (referred to hereinafter as "unvoiced sound first formant level to fourth formant level UF LEVEL1 to UF LEVEL4"), and information SHAPE designating the shape of the formants. The parameter sets PHPAR[*] are provided in a number corresponding to the number (approximately several tens) of kinds of phonemes to be sounded.

Next, characteristics of transition from one phoneme to another are defined by a parameter set PHCOMB[1-2], where the numbers "1" and "2" represent respective names of phonemes, such as "s", "a" and "i". For instance, a parameter set PHCOMB[s-a] represents characteristics of transition from the phoneme "s" to the phoneme "a". When a phoneme rises or starts to be sounded from a silent state, a character corresponding to "1" is made blank as in "PHCOMB[-s].

Therefore, the number of parameter sets PHCOMB[1-2] can be approximately equal to the number of parameter sets PHPAR[*] squared. Actually, however, the former is far less than the latter. This is because the phonemes are classified into several groups, such as a group of voiced consonant sounds, a group of unvoiced consonant sounds, and a group of fricative sounds, and if there exists a characteristic common or convertible between phonemes belonging to the same group, there is a high possibility that an identical parameter set PHCOMB[1-2] can be used for the phonemes belonging to the same group.

FIG. 12B shows details of the parameter set PHCOMB [1-2]. In the penultimate row in the figure, there is provided a parameter called a coarticulation time COMBI TIME. This parameter indicates a time period required for transition from one phoneme to another (e.g. from "s" to "a")for the phonemes to sound natural.

Next, in the last or bottom row of the FIG. 12B format, there is provided a parameter RCG TIME called a phoneme-recognizing time. This parameter indicates a time period to elapse within the coarticulation time COMBI TIME before a phoneme being sounded starts to be heard as such. Therefore, the phoneme-recognizing time RCG TIME is always set to a shorter time period than the coarticulation time COMBI TIME.

Next, a parameter VF LEVEL CURVE1 shown in the top row of the FIG. 12B format indicates a preceding phoneme voiced sound amplitude decreasing characteristic which defines how the preceding phoneme as a voiced sound should decrease in level within the coarticulation time COMBI TIME. A parameter UF LEVEL CURVE1 in the second row of the figure is a preceding phoneme unvoiced sound amplitude decreasing characteristic which, similarly to the parameter VF LEVEL CURVE1, defines how the preceding phoneme as an unvoiced sound should decrease in level within the coarticulation time COMBI TIME. The preceding phone unvoiced sound amplitude decreasing characteristic can be designated e.g. as "linear",or "exponential".

Next, a parameter VF FREQ CURVE2 in the following row indicates a following phoneme voiced sound formant frequency varying characteristic which defines how transition should take place from a formant frequency of the preceding phoneme as a voiced sound to a formant frequency of the following phoneme as a voiced sound.

Further, a parameter UF FREQ CURVE2 designates a following phoneme unvoiced sound formant frequency varying characteristic which, similarly to the parameter VF FREQ CURVE2, defines how a transition should take place from a formant frequency of the preceding phoneme as an unvoiced sound to a formant frequency of the following phoneme as an unvoiced sound. A parameter VF LEVEL CURVE2 indicates a following phoneme voiced sound amplitude increasing characteristic which defines how a formant level of the following phoneme as a voiced sound should rise, while a parameter UF LEVEL CURVE2 indicates a following phoneme unvoiced sound amplitude increasing characteristic which, similarly to the parameter VF LEVEL CURVE2, defines how a formant level of the following phoneme as an unvoiced sound should rise.

Next, parameters VF INIT FREQ1 to VF INIT FREQ4 indicate first to fourth formant initial center frequencies of a voiced sound, respectively, which are applied when a voiced sound rises from a silent state (e.g. in the case of the parameter PHCOMB[ -s]). These parameters indicate initial values of first formant center frequency VF FREQ1 to fourth formant center frequency VF FREQ4. Parameters UF INIT FREQ1 to UF INIT FREQ4 indicate first to fourth formant initial center frequencies of an unvoiced sound, respectively, which, similarly to the parameters VF INIT FREQ1 to VF INIT FREQ4, designate initial values of the unvoiced sound first formant center frequency UF FREQ1 to fourth center frequency UF FREQ4. It should be noted that when a sound rises from a silent state, the preceding phoneme voiced sound amplitude decreasing characteristic VF LEVEL CURVE1 and the preceding phoneme unvoiced sound amplitude decreasing characteristic UF LEVEL CURVE1 are ignored.

Figure 12C:
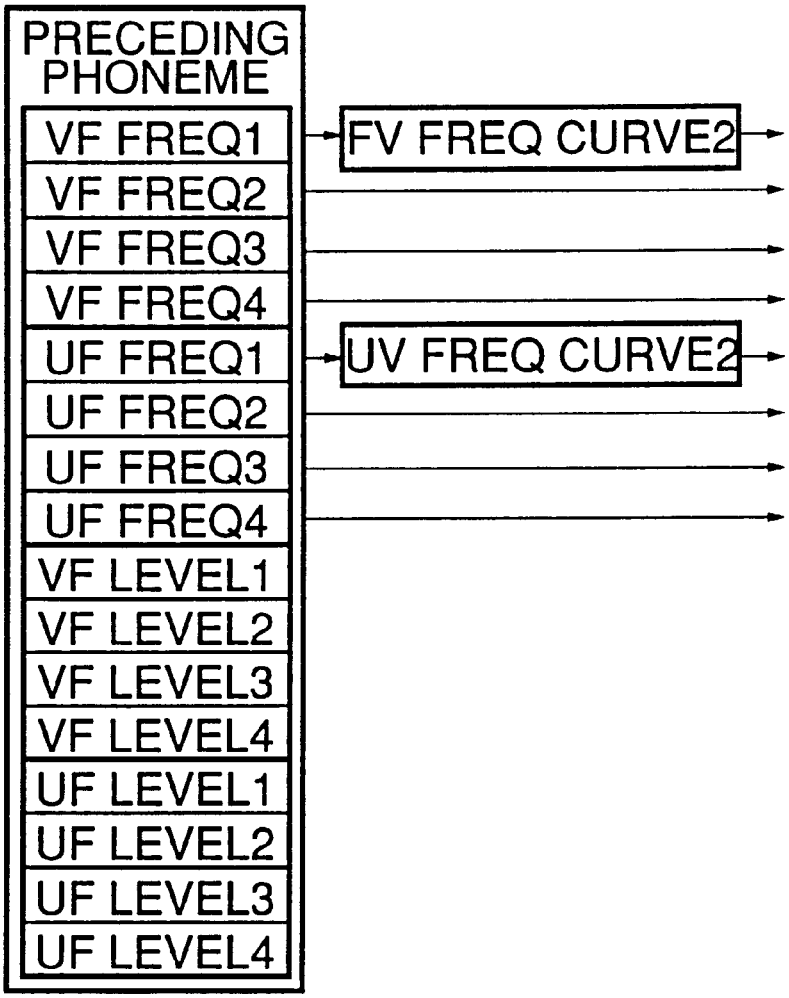
Figure 12D:
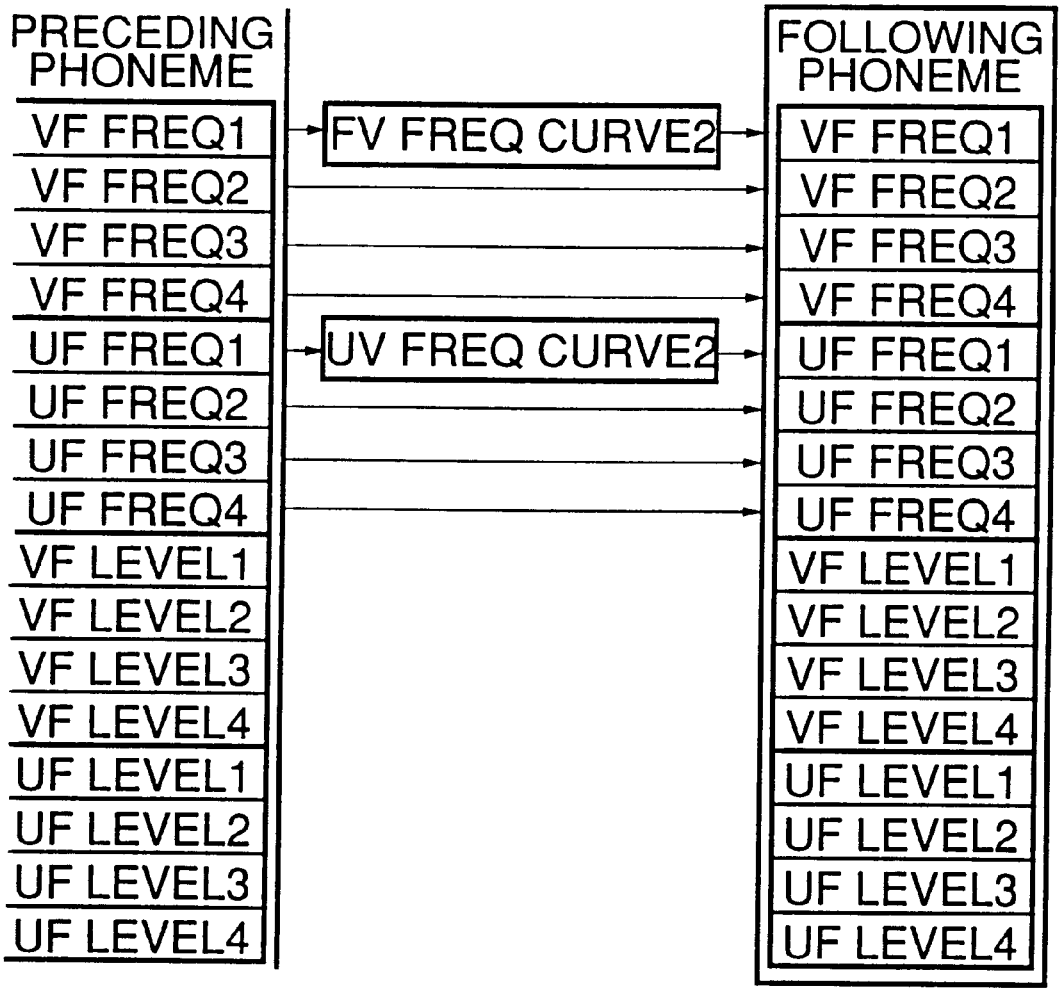

Now, referring to FIGS. 12C and 12D, description will be made of settings for effecting a transition from the phoneme "s" being sounded in a steady state via each channel of the tone generator to the phoneme "a" to be sounded in a steady state.

First, a time period corresponding to a coarticulation time COMBI TIME of a parameter set PHCOMB[s-a] to elapse from the timing of starting the transition from the phoneme "s" to the phoneme "a" is set as a transition time period.

Then, within the set transition time period, the tone generator is controlled such that the voiced sound first formant center frequency to fourth formant center frequency VF FREQ1 to VF FREQ4 are varied according to the following phoneme voiced sound formant frequency varying characteristic VF FREQ CURVE2. Further, the unvoiced sound first formant center frequency to fourth formant center frequency UF FREQ1 to UF FREQ4 are varied according to the following phoneme unvoiced sound formant frequency varying characteristic UF FREQ CURVE2.

At the same time, the voiced sound first formant level to fourth formant level VF LEVEL1 to VF LEVEL4 and the unvoiced sound first format level to fourth formant level UF LEVEL1 to UF LEVEL4 for the phoneme "s" are decreased according to the preceding phoneme voiced sound amplitude decreasing characteristic VF LEVEL CURVE1 and the preceding phoneme unvoiced sound amplitude decreasing characteristic UF LEVEL CURVE1, respectively, while the voiced sound first formant level to fourth formant level VF LEVEL1 to VF LEVEL4 and the unvoiced sound first formant level to fourth formant level UF LEVEL 1 to UF LEVEL4 for the phoneme "a" are increased according to the following phoneme voiced sound amplitude increasing characteristic VF LEVEL CURVE2 and the following phoneme unvoiced sound amplitude increasing characteristic UF LEVEL CURVE2, respectively.

Figure 10:
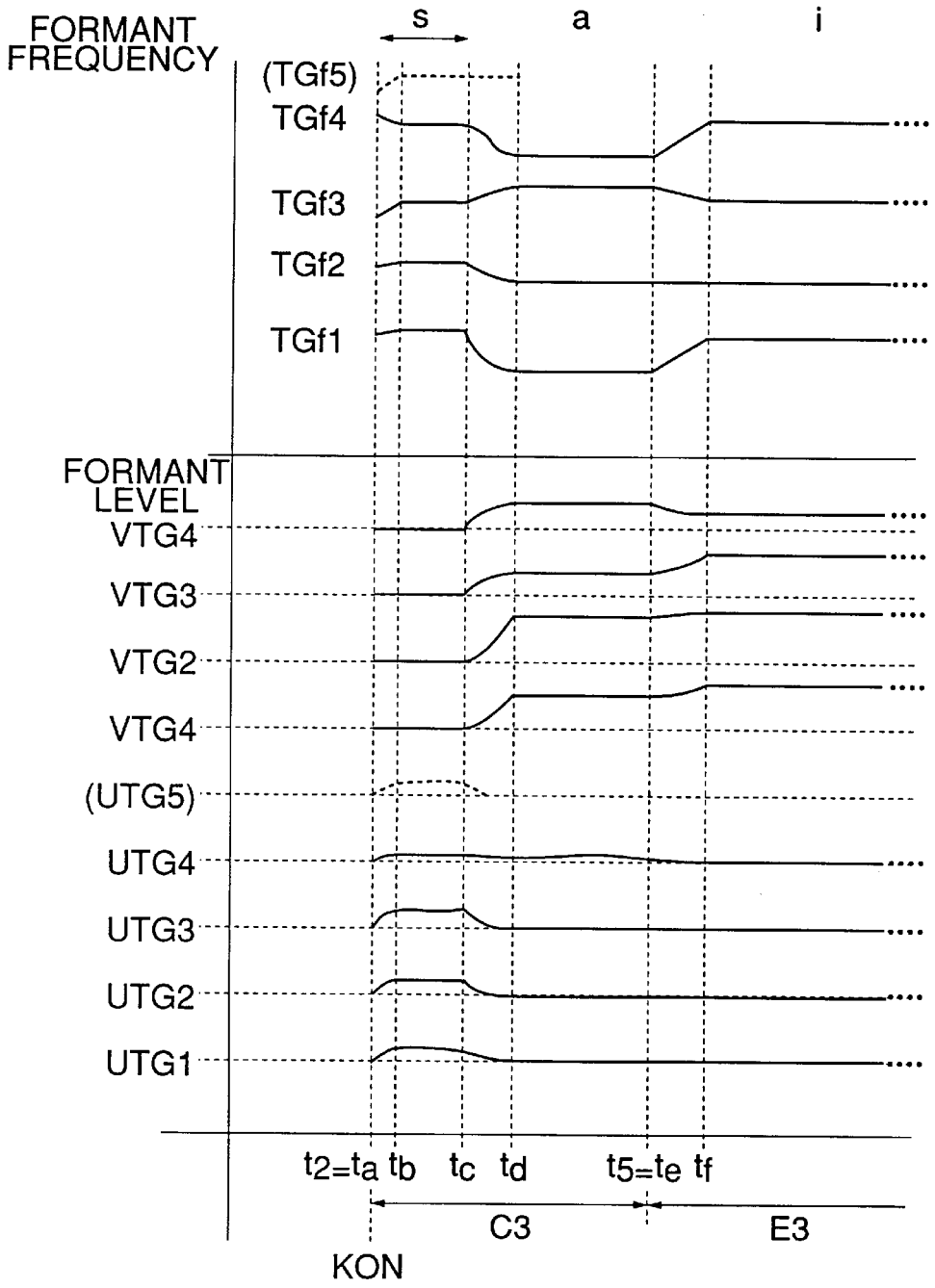
FIG. 10 is a diagram showing examples of changes in formant frequencies and formant levels set for channels of a tone generator 4 appearing in FIG. 2.
Figure 11:
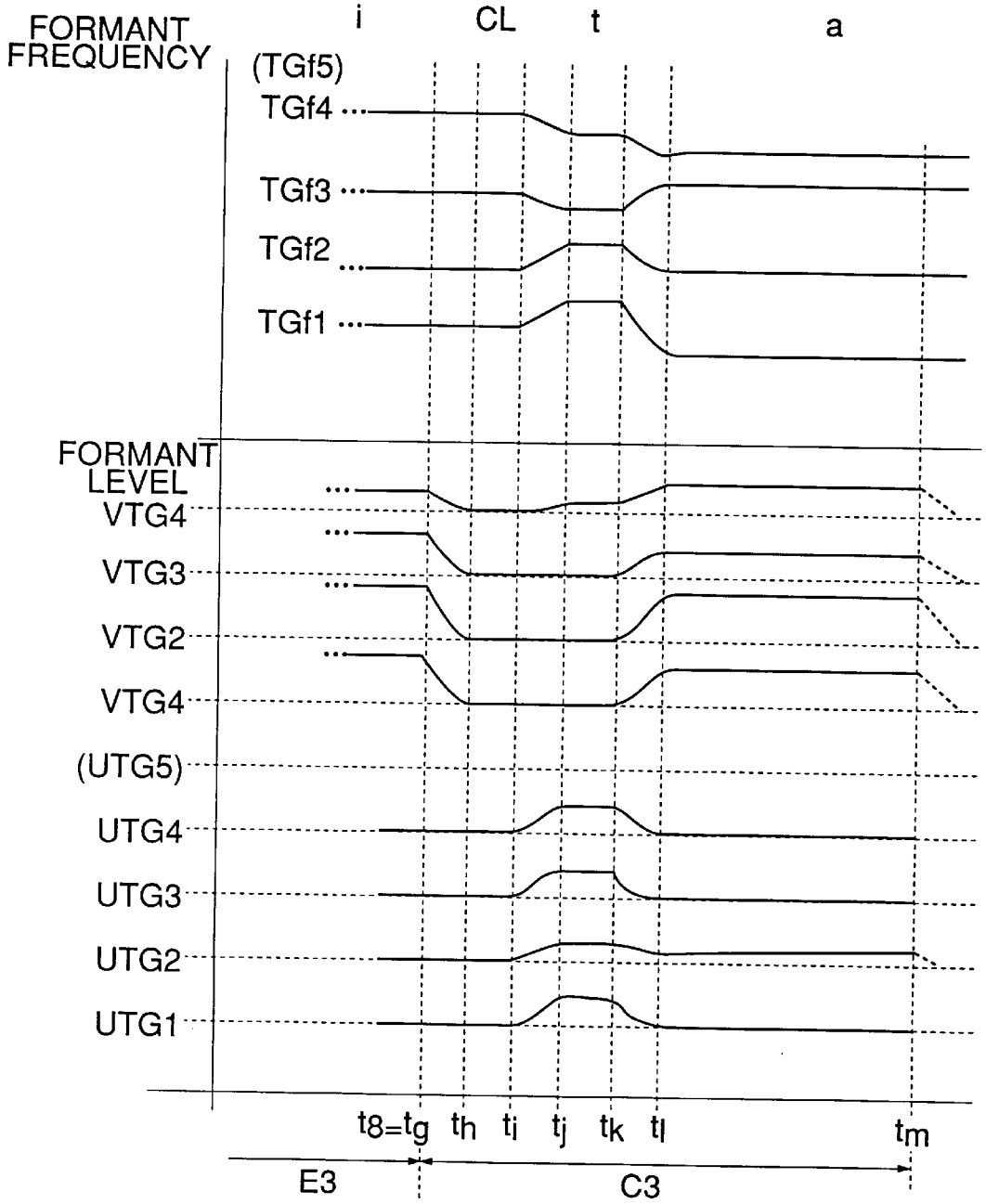
FIG. 11 is a diagram continued from FIG. 10.

In doing this, the voiced sound first formant level, for instance, of the sound generator is the sum of the level of the first formant of the phoneme "s" and the level of the first formant of the phoneme "a". FIGS. 10 and 11 show settings of the channels of the tone generator thus made on the formants of singing sounds to be generated according to the lyrics portion "さいた(bloomed)" having phonemes "saita ".

In these figures, it is assumed that the unvoiced sound formant frequencies UTGf1 to UTGf4 and the voiced sound formant frequencies VTGf1 to VTGf4 are equal to each other, and collectively designated as "formant frequencies TGf1 to TGf4". Further, these figures only show mere examples of transitions in formant levels and formant frequencies, but not ideal examples of transitions.

Figure 13A:
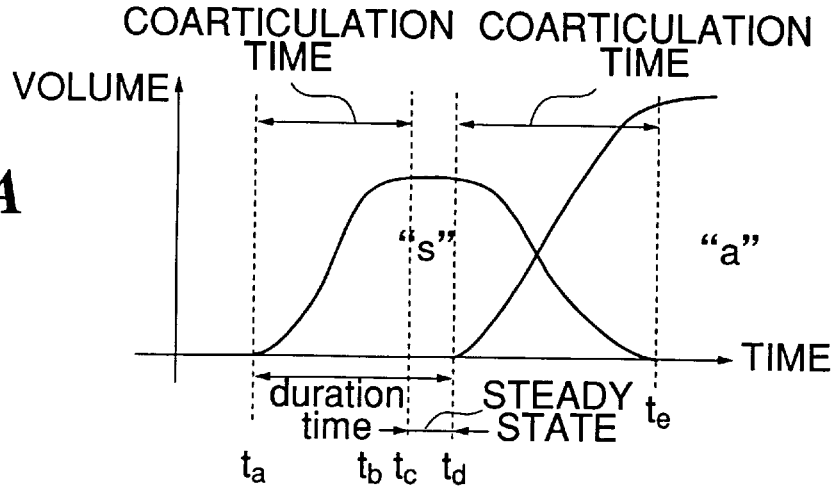
FIGS. 13A to 13D are diagrams showing various manners of transition between phonemes which should take place when a note-on event has occurred.

Next, FIG. 13A shows the relationship between the articulation time COMBI TIME and the duration exhibited when the phonemes "s" and "a" are sounded. As will be understood from the aforegiven description, the coarticulation time COMBI TIME is determined directly by the kinds of phonemes to be coarticulated, and the duration is defined by a MIDI signal therefor.

As can be seen from the figure, a value obtained by subtracting the coarticulation time from the duration is a time period for sounding the phoneme in a steady state. The phoneme "s" does not sound like "s" to the human ear from the start (time point $t_a$) of the coarticulation time, but starts to sound like "s" at a time point $t_b$ only after a certain time period (phoneme-recognizing time RCG TIME) has elapsed.

Figure 13B:
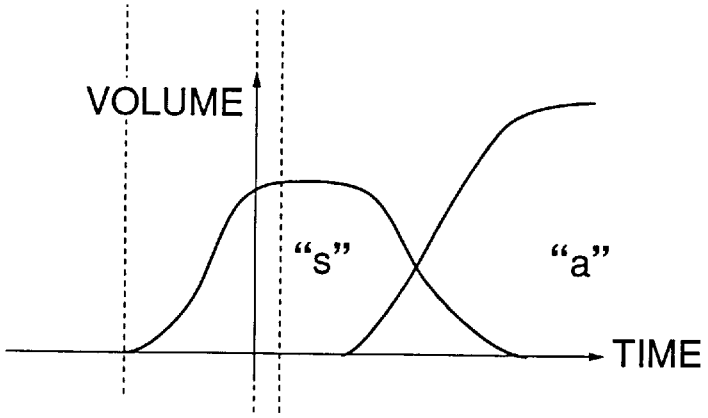

Therefore, to synthesize an instrument sound and a singing sound as if they were generated simultaneously, it is desirable to shift the timing of generating the singing sound such that the timing of note-on of the instrument sound (indicated by a thick solid line in FIG. 13B) and the time point $t_b$ are coincident with each other, as shown in FIG. 13B.

However, in practice, it is very difficult to control the timing of generating a singing sound as shown in FIG. 13B. This is because, to effect the sounding as shown in FIG. 13B, it is required to start generating the singing sound before note-on of the instrument sound, and therefore it is required to predict timing of the note-on of the instrument sound to be generated in the future, which is very difficult to carry out.

Therefore, the solution depends upon how to make the timing of starting generation of a singing sound coincide with the timing of note-on of an instrument sound by setting the former to or after the latter. To this end, the present inventor studied and tested various methods as follows:

1. Method of delaying the timing of starting the sounding of a starting phoneme alone.

Figure 13C:
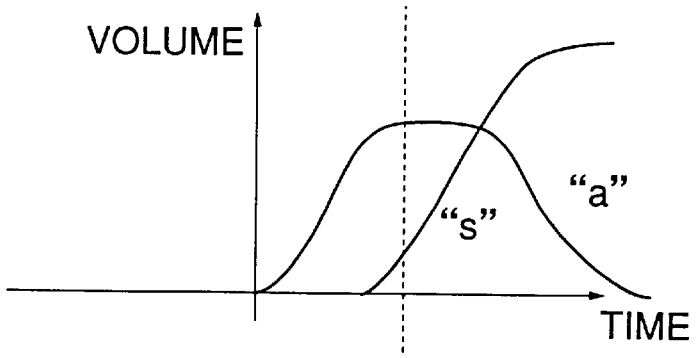

First, the timing of starting the sounding of the starting phoneme of a singing sound is set to the same timing as the timing of note-on of an instrument sound (i.e. the timing of starting the sounding of the starting phoneme is delayed compared with the ideal timing), and the following phonemes are sounded at the same timing as the ideal timing. FIG. 13C shows a transition between the phonemes based on this method.

According to this method, however, most part of a steady-state time period of the phoneme "s" overlaps the time period of sounding of the phoneme "a" so that the phoneme "s" is scarcely recognized by the hearing. That is, in this case, only a sound of "a" with slight noise is heard by the listener, and it is difficult for him to recognize the sound as "sa".

2. Method of cutting off a portion of the waveform of the preceding phoneme before the time point $t_b$.

Figure 13D:
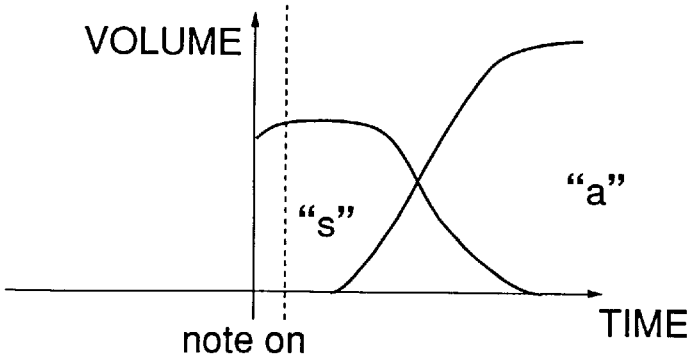

A method of cutting off a portion of the waveform of the preceding phoneme before the time point $t_b$ was also studied. FIG. 13D shows a transition between the phonemes based on this method. This method has the disadvantage that the level of the phoneme "s" suddenly rises so that the resulting sound is very unnatural as a human voice.

3. Method of delaying all the phonemes.

Figure 14A:
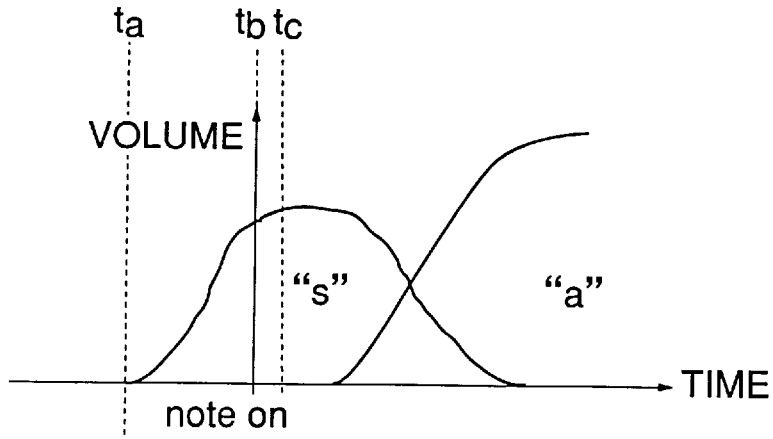
FIGS. 14A to 14C are diagrams showing other manners of transition between phonemes which should take place when a note-on event has occurred.
Figure 14B:
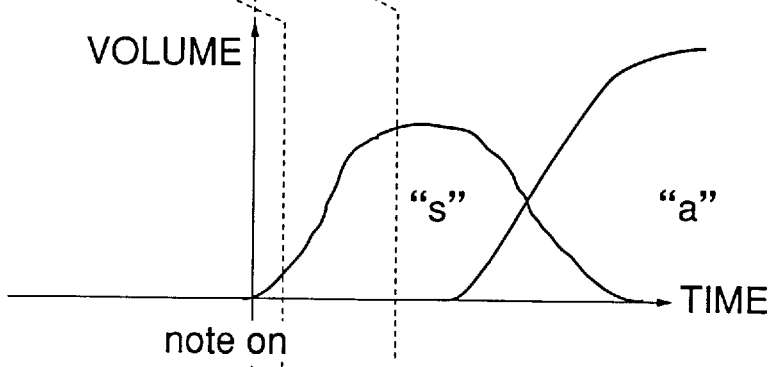

A method of delaying the timing of starting the sounding of the phoneme "s" to the timing of note-on of the instrument sound and also successively delaying the following phonemes was also studied. FIG. 14B shows a transition based on this method. This method has the disadvantage that the delaying of generation of the singing sound makes the resulting sound unnatural.

4. Method of delaying all the related events.

In the art of the electronic musical instrument, a technique, not shown, is known in which MIDI signals are uniformly delayed by a predetermined time period to thereby delay generation of sounds. Assuming that the predetermined time period is e.g. "300 milliseconds",the timing of note-on of instrument sounds is uniformly delayed by "300 milliseconds".

On the other hand, the delay time of sounding of a singing sound may be determined according to a time period for sounding before the aforementioned note-on of the instrument sound. For instance, assuming that the time period $t_a$ to $t_b$ (phoneme-recognizing time RCG TIME) is equal to "50 milliseconds",the sounding of phonemes starting with the phoneme "s" may be delayed by a time period of "250 milliseconds".

This makes it possible to generate the phonemes with a predetermined delay time almost in accordance with the ideal transition as shown in FIG. 13A. This method is most suitable for reproducing MIDI signals of recorded sounds. However, if performance made in real time is involved, there is a large discrepancy between the timing of performance and the timing of generation of sounds, which gives unnatural feelings to the player.

5. Method of compressing the coarticulation time of the starting phoneme.

As a result of the inventor's studies, he found that a method of compressing the coarticulation time of the starting phoneme along the time axis is substantially free from the defects of the above described methods. In the case of the example discussed above, the time period of a transitional state within the coarticulation time in the ideal form (between the time points $t_a$ to $t_c$ in FIG. 14A) is compressed or shortened along the time axis, thereby setting the same to a time period of a transitional state from the time point $t_b$ of note-on of the instrument sound to the time point $t_c$.

Figure 14C:
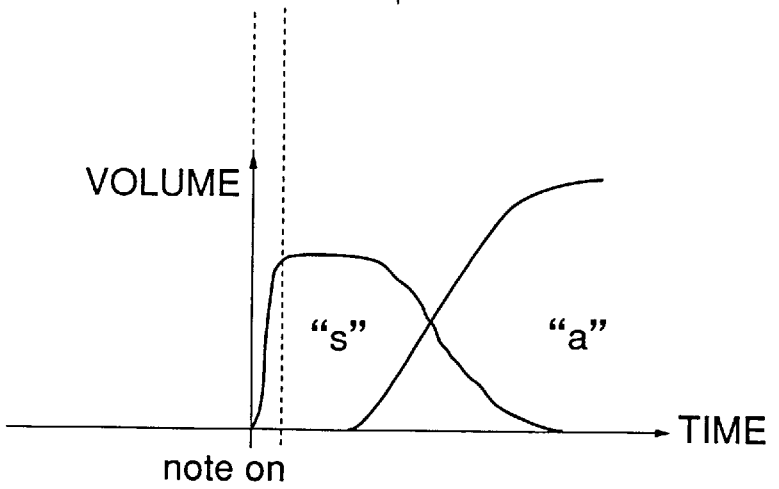

FIG. 14C shows a transition between the phonemes based on this method. In the figure, the coarticulation time of the phoneme "s" is shortened, but within this shortened time range, the starting phoneme "s" smoothly rises in level, so that a far better vocal sound can be synthesized compared with the vocal sound based on the FIG. 13D method. Further, when the phoneme "s" is in a steady state, the phoneme "a" is still low in energy level, which makes it possible to clearly distinguish the phoneme "s" from the phoneme "a".

Next, the arrangement of the electronic musical instrument according to the present embodiment will be described with reference to FIG. 2.

Figure 2:
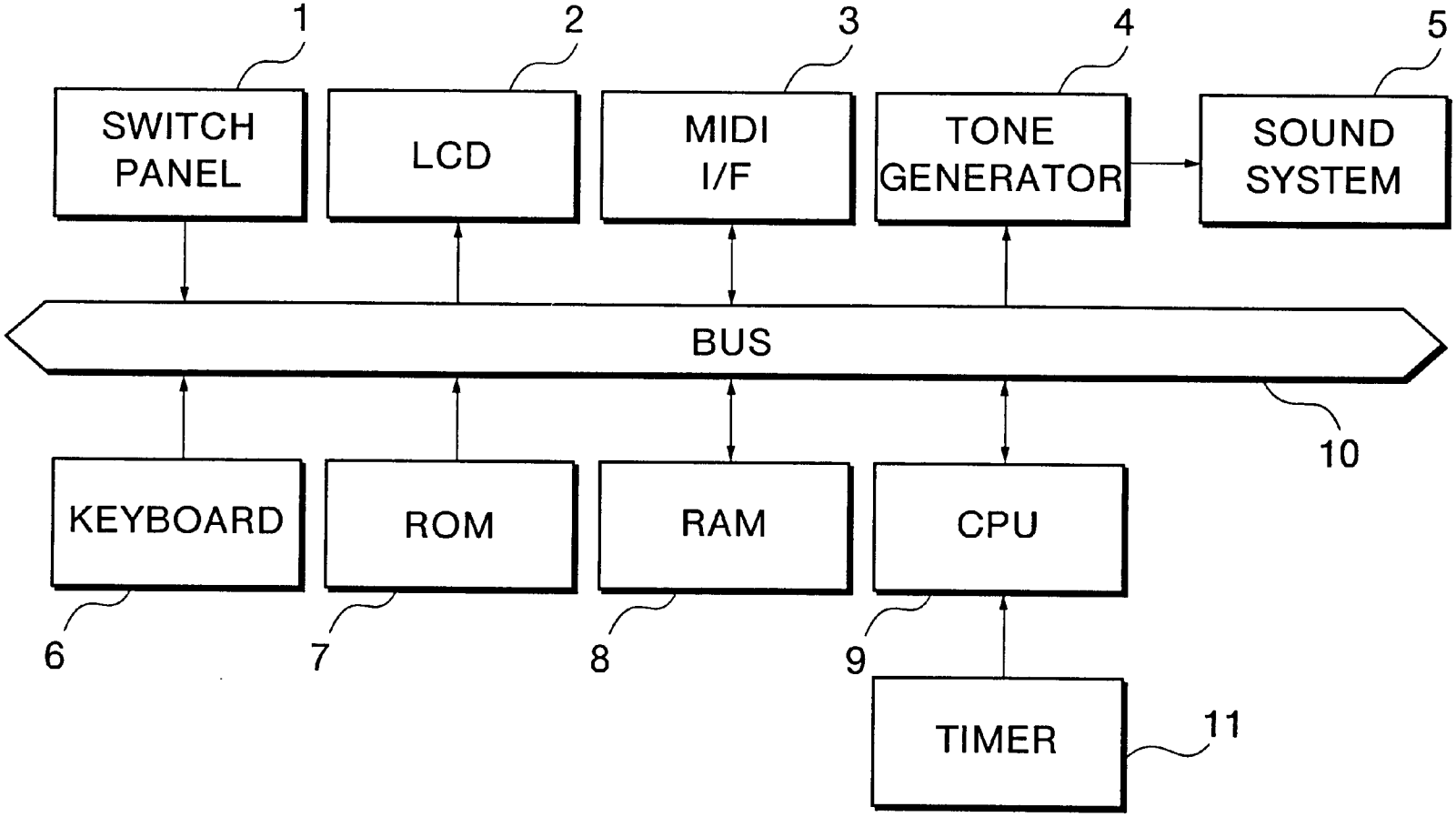
FIG. 2 is a block diagram showing the arrangement of an electronic musical instrument incorporating a musical sound synthesizer according to a first embodiment of the invention.

In FIG. 2, reference numeral 9 designates a CPU (central processing unit) 9 for controlling other components of the instrument according to programs stored in a ROM (read only memory) 7. Reference numeral 8 designates a RAM (random access memory) used as a working memory for the CPU 9. Reference numeral 1 designates a switch panel having switches via which the user can make settings of the instrument, such as timbres of musical sounds to be generated. These settings are displayed on a liquid crystal display 2.

Reference numeral 6 designates a keyboard having keys which are operated by the user for generating performance data to be input through a bus 10. Reference numeral 3 designates a MIDI interface via which the CPU 9 sends and receives MIDI signals to and from an external device. When a MIDI signal is received from the external device, the MIDI interface 3 generates an interrupt (MIDI signal-receiving interrupt) to the CPU 9.

Reference numeral 4 designates a tone generator for generating musical sound signals for singing sounds and the like based on performance data input via the bus 10. As described hereinbefore, the tone generator 4 has "four" channels assigned to the formants of each of a voiced sound and an unvoiced sound, and the formant frequency and the formant level to be set for each channel can be updated by the CPU 9. Reference numeral 5 designates a sound system for generating sounds based on the musical sound signals generated. Reference numeral 11 designates a timer for generating and delivering an interrupt (timer interrupt) signal to the CPU 9 at predetermined time intervals.

Figure 4:
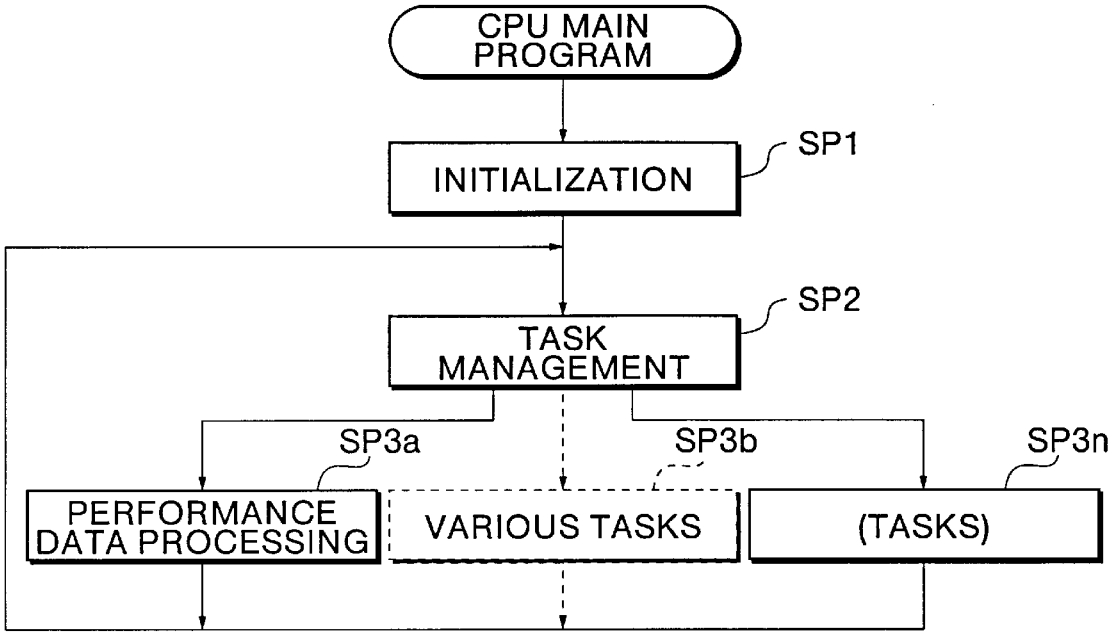
FIG. 4 is a flowchart showing a main routine executed by the first embodiment.

First, initial operations of the electronic musical instrument will be described. When the power of the electronic musical instrument is turned on, the CPU 9 starts executing a main routine shown in FIG. 4. In the figure, at a step SP1, a predetermined initializing operation is carried out. Then, the program proceeds to a step SP2, wherein task management is carried out. That is, in response to interrupt signals, a plurality of routines (tasks) are carried out in parallel in a manner being selectively switched from one routine to another.

Of these routines, a MIDI signal-receiving interrupt-handling routine is given a top-priority and executed in response to a MIDI signal-receiving interrupt signal. A second-highest priority routine is a timer interrupt-handling routine executed in response to each timer interrupt signal.

The other routines have respective priorities lower than those of the above two routines. One of the lower priority routines is a performance data-processing routine described hereinafter, which can be executed when the above interrupt-handling routines are not executed.

Figure 5:
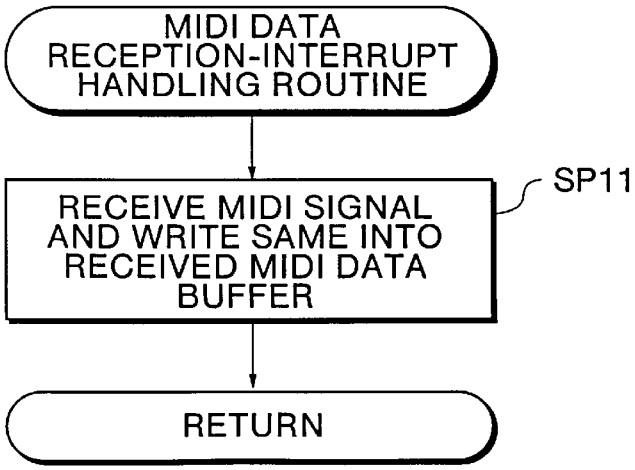
FIG. 5 is a flowchart showing a MIDI signal-receiving interrupt-handing routine.

When a MIDI signal is received via the MIDI interface 3 or an event is generated via the keyboard 6, the MIDI signal-receiving interrupt-handling routine shown in FIG. 5 is started. In the figure, at a step SP11, data of the MIDI signal received or information on operation of the keyboard 6 is written into a predetermined area (MIDI signal-receiving buffer) within the RAM 8, immediately followed by terminating the program.

The information on the operation of the keyboard 6 includes note-on information including a note number and a velocity, note-off information including a note number, etc. The two kinds of information have contents similar to those of MIDI signals indicative of instrument sounds. Therefore, in the present specification, MIDI signals supplied-via the MIDI interface and information on operation of the keyboard 6 generated therefrom are collectively called "the MIDI signals".

Now, the operation of the electronic musical instrument according to the present embodiment will be described assuming that the MIDI signals shown in FIG. 3 are sequentially received via the MIDI interface and stored in the MIDI signal-receiving buffer from the time point $t_1$ to the time point $t_9$.

Figure 6:
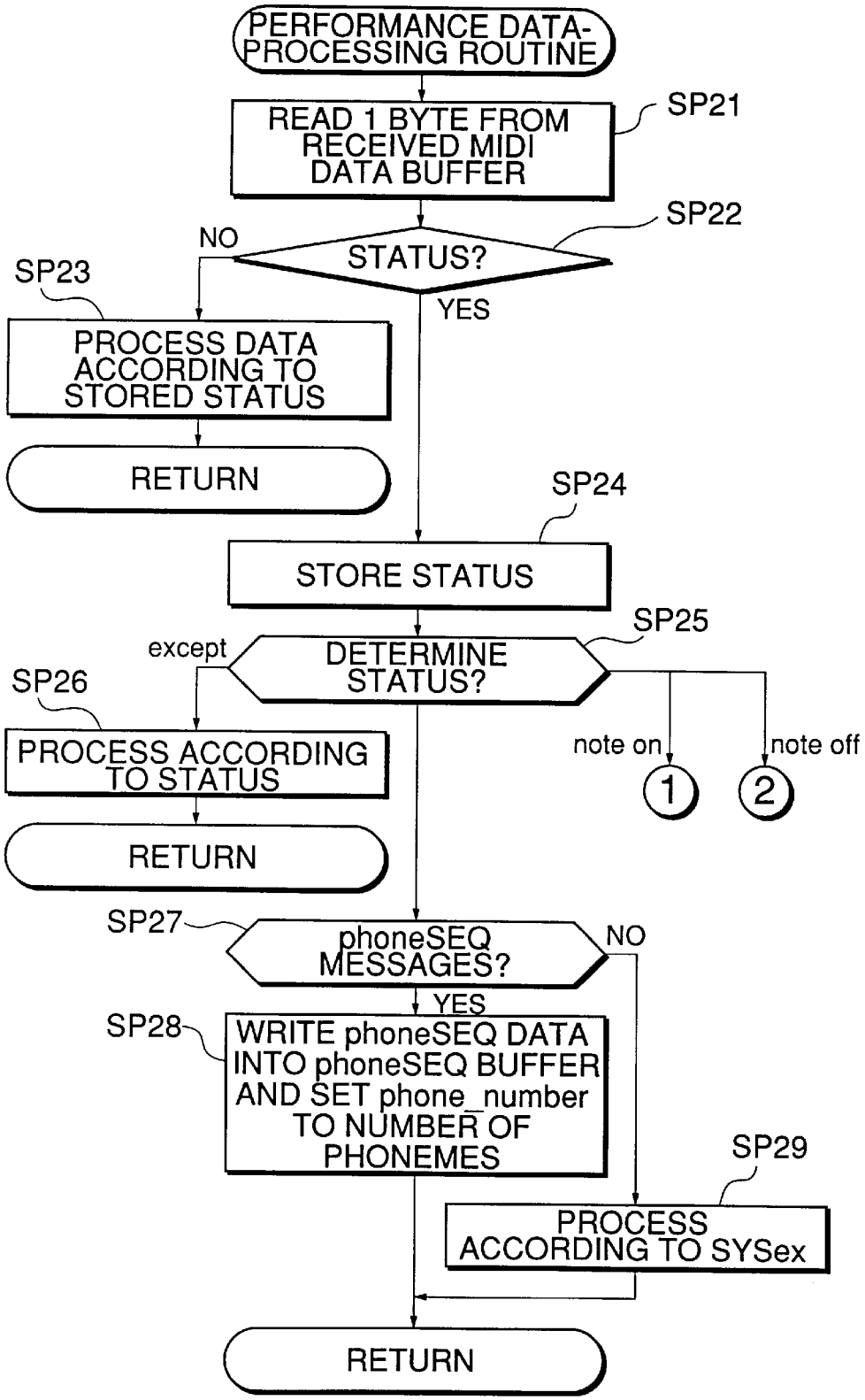
FIG. 6 is a flowchart showing a performance data-processing routine.

When phone sequence data related to the sound of "さ(sa)" is stored in the MIDI signal-receiving buffer at the time point $t_1$, the performance data-processing routine (step SP3*a* in FIG. 4) is started at a suitable timing (i.e. when no interrupt-handling routine is being executed). FIG. 6 shows details of the routine, in which, first, at a step SP21, one byte of MIDI signal is read from the MIDI signal-receiving buffer.

In the example shown in FIG. 3, the starting byte of the first MIDI signal supplied at the time point t, is 'F0', and therefore the data 'F0' is read from the MIDI signal-receiving buffer. Then, the program proceeds to a step SP22, wherein it is determined whether or not the read data of the MIDI signal is a status byte (a value within a range of '80' to 'FF'). In the present case, the answer to this question is affirmative (YES), and then the program proceeds to a step SP24, wherein the kind of the status byte (a signal indicative of start of the system exclusive in the present case) is stored in a predetermined area of the RAM 8.

Then, at a step SP25, the kind of the status byte is determined. If the status byte is determined to be indicative of the start of the system exclusive, the program proceeds to a step SP27, wherein four bytes of data of the MIDI signal following the signal indicative of the start of the system exclusive are read from the MIDI signal-receiving buffer, and it is determined whether or not the read data is the phone sequence header.

In the example shown in FIG. 3, the data of '43', '1n', '7F' and '03' following the data 'F0' at the time point $t_1$ are read from the MIDI signal-receiving buffer. Since the read data is exactly the phone sequence header, the answer to the question of the step SP27 is affirmative (YES), and then the program proceeds to a step SP28.

At the step SP28, phone sequence data stored within the MIDI signal-receiving buffer are sequentially read out and stored in a predetermined area phoneSEQbuffer within the RAM 8 until the system exclusive-terminating signal 'F7' is read out. In the illustrated example, data of the phonemes "s" and "a" and durations thereof are stored in the area phoneSEQbuffer.

Further, at the step SP28, the number of phonemes ("2" in the present case) is assigned to a variable called phone number, followed by terminating the present routine. Hereafter, the timer interrupt-handling routine shown in FIG. 9 is started whenever a timer interrupt signal is generated at time intervals of 5 milliseconds.

Figure 9:
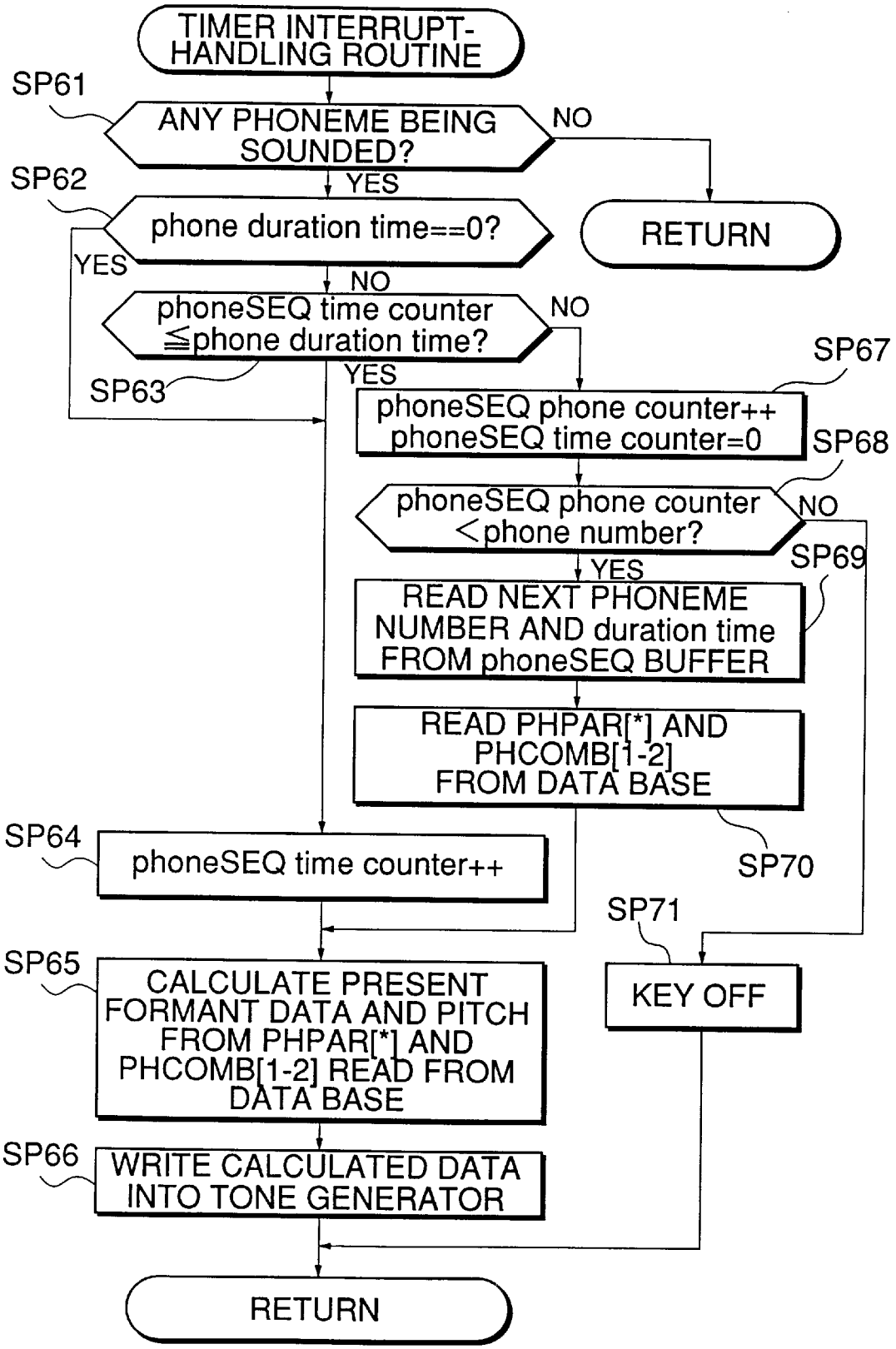
FIG. 9 is a flowchart showing a timer interrupt-handling routine.

In FIG. 9, first, at a step SP61, it is determined whether or not a phoneme is currently being sounded. If it is determined that there is no phoneme being sounded, the program is immediately terminated. In the above example, none of the phonemes contained in the phone sequence data taken in at the time point $t_1$ are being sounded, so that practically no processing is carried out by the timer interrupt-handling routine.

Then, at the time point $t_2$the note-on data of "C3" is supplied through the MIDI interface 3, whereupon the MIDI signal-receiving interrupt-handling routine is executed to write the note-on data into the MIDI signal-receiving buffer. Then, the performance data-processing routine is started again.

Referring again to FIG. 6, at the step SP21, the starting byte '90' of the MIDI signal received at the time point $t_2$ is read from the MIDI signal-receiving buffer. This data is a status byte, and therefore the program proceeds through the step SP22 to the step SP24.

If the starting byte of the MIDI signal is '90', this data is either a note-on or a note-off. Therefore, if it is determined at the step SP24 that the starting byte is '90', the following two byte data are read out to determine whether the data of the MIDI signal is a note-on or a note-off.

In the above example, the data following '90' are '30' and '42'. Since the velocity '42' has a value other than '00', the status of the MIDI signal is determined to be a note-on, and the data is stored in the RAM 8. Then, depending on results of the determination, the program proceeds through the step SP25 to a step SP31 in FIG. 7.

At the step SP31, "0" is set to both of a variable phoneSEQtime counter and a variable phoneSEQphone counter. The variable phoneSEQpone counter is for designating the present phoneme currently being sounded, out of the phonemes included in the present note ("s" and "a").

That is, the variable phoneSEQphone counter designates the starting phoneme when "0" is set thereto, and is then sequentially incremented by "1" to designate each of the following phonemes. The variable phoneSEQtime counter is for measuring or counting a time period elapsed after the present phoneme started to be sounded, in units of 5 milliseconds Then, at a step SP32, it is determined whether or not data named "breath information" exists within a "1" note (phone sequence data supplied at the time point $t_1$ in the above example) at a starting area of the area phoneSEQbuffer. The breath information is a signal for designating breathing, and has a predetermined number assigned thereto similarly to the other phonemes.

In the present example, no breath information exists, so that the answer to the question of the step SP32 is negative (NO), and then the program proceeds to a step SP33, wherein a breath flag fkoki is set to "0"Then, at a step SP35, the phoneme number of the starting phoneme and data of duration thereof are extracted from the area phoneSEQbuffer.

In the above example, the phoneme number '35' of the phoneme "s" and the duration 'OA' thereof are extracted. Then, at a step SP36, the parameter set PHPAR[*] and the parameter set PHCOMB[1-2] are read from the data base within the ROM 7 according to the preceding and following phonemes. In the present example, since the phoneme "s" is started from a silent state, the parameter set PHPAR[s] and the parameter set PHCOMB[ -s] are read out.

Then, at a step SP37, it is determined whether or not the coarticulation time COMBI TIME within the parameter PHCOMB[ -s] is shorter than the duration of the phoneme "s". If the answer to this question is negative (NO), the program proceeds to a step SP38, wherein the coarticulation time is set to a value of the duration again.

By way of the step SP38 or directly from the step SP37 (the answer to the question being affirmative), the program proceeds to a step SP39, wherein varying characteristics applied to the phoneme (s) are calculated. However, if it is required to compress or shorten the coarticulation time before carrying out the calculation, or if the coarticulation time has already been compressed at the step SP38, the compressed coarticulation time is applied.

In the above example, the phoneme "s" is positioned immediately after the phone sequence header, which means that it should be sounded in synchronism with a note-on of the instrument sound. Therefore, according to the rules described hereinbefore with reference to FIGS. 14A and 14C, the varying characteristics read from the data base are compressed along the time axis.

That is, these varying characteristics, which originally represent those within the normal or non-compressed coarticulation time COMBI TIME, are compressed along the time axis such that the transition from the preceding phoneme to the following phoneme is completed within a time period "COMBI TIME—RCG TIME". Further, even when the step SP38 has been executed in advance for a phoneme to be sounded after the phoneme "s", the varying characteristics are compressed according to the updated (compressed) coarticulation time.

Then, according to the varying characteristics (properly compressed characteristics), formant data corresponding to a current value ("0" in the present case) of the variable phoneSEQtime counter are calculated. Then, the program proceeds to a step SP40, wherein the calculated formant data are written into the channels of the tone generator 4 for singing sounds.

Further, if the channels of the tone generator 4 for singing sounds are in a note-off state, a note-on signal for the formant data is also supplied to the tone generator 4. In the above example, the phoneme "s" is assumed to be a first singing sound in the musical piece, and hence a note-on signal therefor is also supplied to the tone generator 4.

This process causes starting generation of the singing sound related to the phoneme "s". Further, it goes without saying that at the step SP40, a note-on signal for the instrument sound is also supplied to the tone generator 4. When the above process is completed, the performance data-processing routine concerning the present note-on event is terminated.

Then, when a timer interrupt signal is generated, the timer interrupt routine shown in FIG. 9 is started. In the present case, since the phoneme "s" is being sounded, the answer to the question of the step SP61 is affirmative (YES), and then the program proceeds to a step SP62.

At the step SP62, it is determined whether or not a variable phone duration time assumes "0" (='00'), i.e. whether or not the duration is indefinite. Since the duration of the phoneme "s" is equal to a value of 10 (='0A'), the answer to the question of the step SP62 is negative (NO), and then the program proceeds to a step SP63, wherein it is determined whether or not the variable phoneSEQtime counter is within the duration.

In the above example, the variable phoneSEQtime counter has already been set to "0" at the step SP31. On the other hand, the duration of the phoneme "s" is equal to the value of "10" (='0A'). Therefore, the answer to this question is affirmative ("YES"), and then the program proceeds to a step SP64, wherein the variable phoneSEQtime counter is incremented by "1".

Then, at a step SP65, formant data corresponding to the current value of the variable phoneSEQtime counter ("1" in the present case) are calculated according to the compressed varying characteristics calculated at the step SP39.

Then, at a step SP66, the calculated formant data are written into the channels of the tone generator 4 for singing sounds. This advances the sounding state of the singing sound related to the phoneme "s" by "5 milliseconds" with respect to each varying characteristic. This completes execution of a portion of the timer interrupt-handling routine to be executed one time.

Thereafter, at time intervals of 5 milliseconds, the same routine is started and the variable phoneSEQtime counter is sequentially incremented by "1" at the step SP64, and based on the resulting variable value, the steps SP65 and SP66 are executed.

By the above operations, the formant data for the tone generator 4 are updated such that the phoneme "s" progressively rises in level. As a result, if the duration is longer than the coarticulation time, the phoneme "s" is sounded in a steady state based on the parameter set PHPAR[s] over a time period corresponding to the difference between the duration and the coarticulation time.

As the incrementing process at the step SP64 is repeatedly carried out, the variable phoneSEQtime counter is sequentially incremented until it exceeds the variable phone duration time. Thereafter, when the timer interrupt-handling routine is called into execution, the program proceeds to the step SP63, wherein it is determined that the variable phoneSEQtime counter is not within the duration, and then the program proceeds to a step SP67.

At the step SP67, the variable phonseSEQ counter is incremented by "1" to be set to "1". That is, this variable now designates the second phoneme "a". The variable phoneSEQtime counter is reset in response to this.

Then, at a step SP68, it is determined whether or not the phoneSEQphone counter is smaller than the variable phone number. Since the value of 2 was assigned to the variable phone number at the step SP28, the answer to this question is affirmative (YES), and then the program proceeds to a step SP69.

At the step SP69, from the area phoneSEQbuffer, the phoneme number of the second phoneme and the duration thereof are read out. In the above example, the phoneme number '20' of the phoneme "a" and the duration '00' of the same are read out.

Then, at a step SP70, the parameter set PHPAR[*] and the parameter set PHCOMB[1-2] are read from the data base within the ROM 7 according to the preceding and following phonemes. In the present example, the tone generator 4 is in a condition of a transition from sounding of the phoneme "s" to sounding of the phoneme "a", and hence the parameter set PHPAR[a] and the parameter set PHCOMB[s-a] are read out.

Then, at the following step SP65, formant data corresponding to the current value of the variable phoneSEQ timer counter ("0" at the present time point) are calculated according to the varying characteristics contained in the parameter set PHCOMB[s-a]. Then, at a step SP66, the formant data calculated at the step SP66 are written into the channels of the tone generator 4 for singing sounds, whereby the transition from the phoneme "s" to the phoneme "a" is started.

Thereafter, as described hereinabove as to the phoneme "s", the timer interrupt-handling routine is started at time intervals of 5 milliseconds, whereby at the step SP64, the variable phoneSEQtime counter is increased by "1", to thereby execute the steps SP65 and SP66 based on the incremented value of the variable.

Thus, the updated formant data are supplied to the tone generator 4 such that transition from the phoneme "s" to the phoneme "a" progressively takes place. After the coarticulation time COMBI TIME of the parameter set PHCOMB [s-a] has elapsed, the phoneme "a" is sounded in a steady state. In the present case, the duration is set to "0", so that the step SP63 is skipped over.

When the MIDI signal containing note-off data of "C3" is supplied through the MIDI interface at the time point $t_3$, the FIG. 5 MIDI signal-receiving interrupt-handling routine is started to write the received data into the MIDI signal-receiving buffer.

Figure 8:
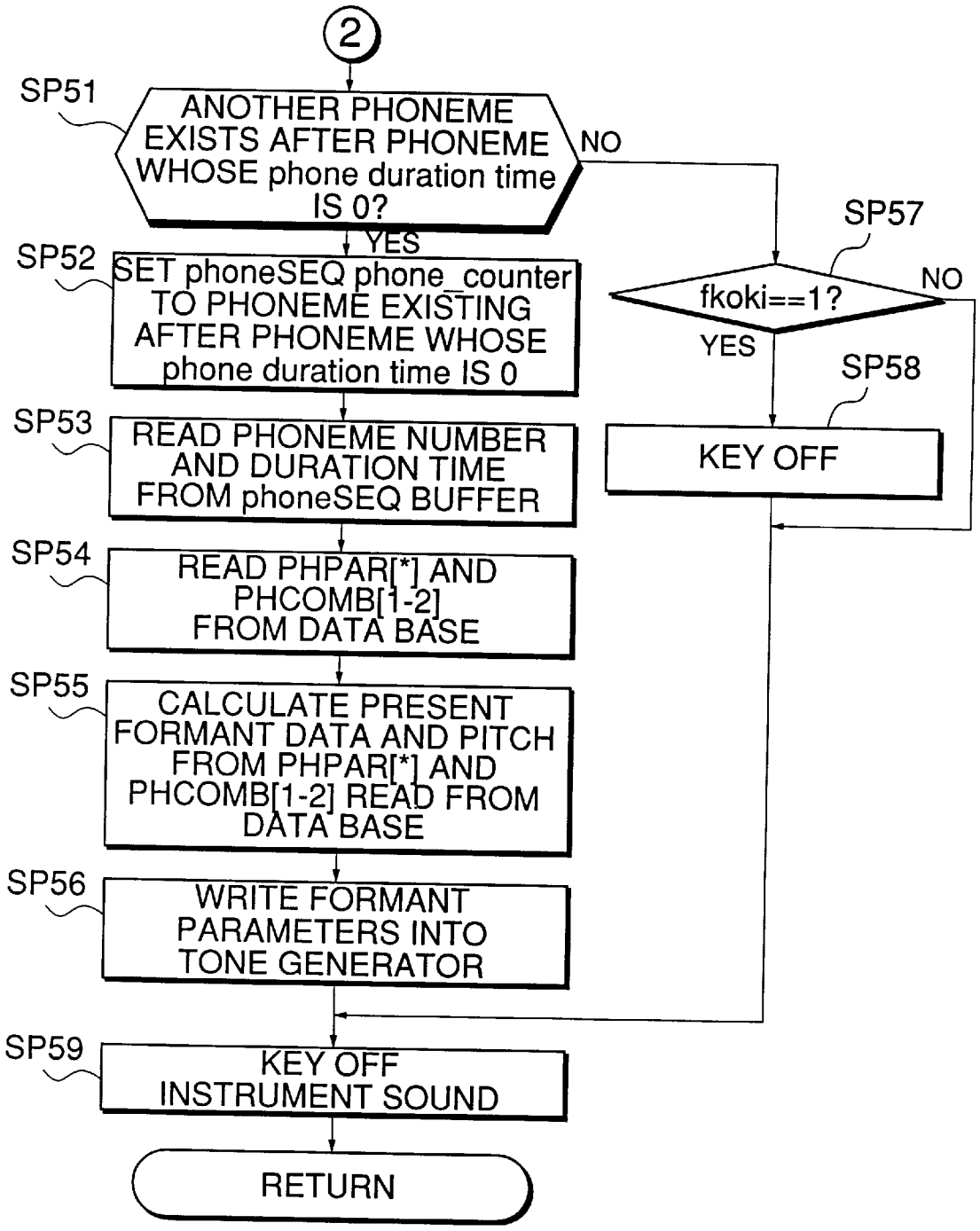
FIG. 8 is a flowchart showing a subroutine for executing a note-off process included in the performance data-processing routine.

Thereafter, when the FIG. 6 performance data-processing routine is started, the note-off signal (note-off data of the MIDI signal) is read from the MIDI signal-receiving buffer at the step SP21, and the program proceeds through the steps SP22 to SP25 to a step SP51 shown in FIG. 8, wherein it is determined whether or not another phoneme exists after the phoneme whose duration is "0".

The phoneme whose duration is "0" in the present case is the phoneme "a", and the MIDI signal supplied at the time point $t_1$ does not contain any data of a phoneme following the phoneme "a". Therefore, the answer to this question is negative (NO), and then the program proceeds to a step SP57.

At the step SP57, it is determined whether or not the breath flag fkoki assumes "1". Since the breath flag fkoki was set to "0" at the step SP33, the answer to this question is negative (NO), and then the program proceeds to a step SP59, wherein a key-off process of the instrument sound is executed.

Thus, the performance data-processing routine related to the note-off process is completed. That is, in the present example, no process having a direct influence on the singing sound is carried out in response to the note-off of the instrument sound. Therefore, even after the execution of the note-off process, the sounding of the phoneme "a" is continued.

Then, when the phone sequence data related to the phoneme "i" are supplied through the MIDI interface 3 at the time point $t_4$, the MIDI signal-receiving interrupt-handling routine is started to write the received data into the MIDI signal-receiving buffer. Thereafter, at the step SP28 of the performance data-processing routine, the phone sequence data are written into the buffer phoneSEQbuffer and a value of 1 is assigned to the variable phone number.

Figure 7:
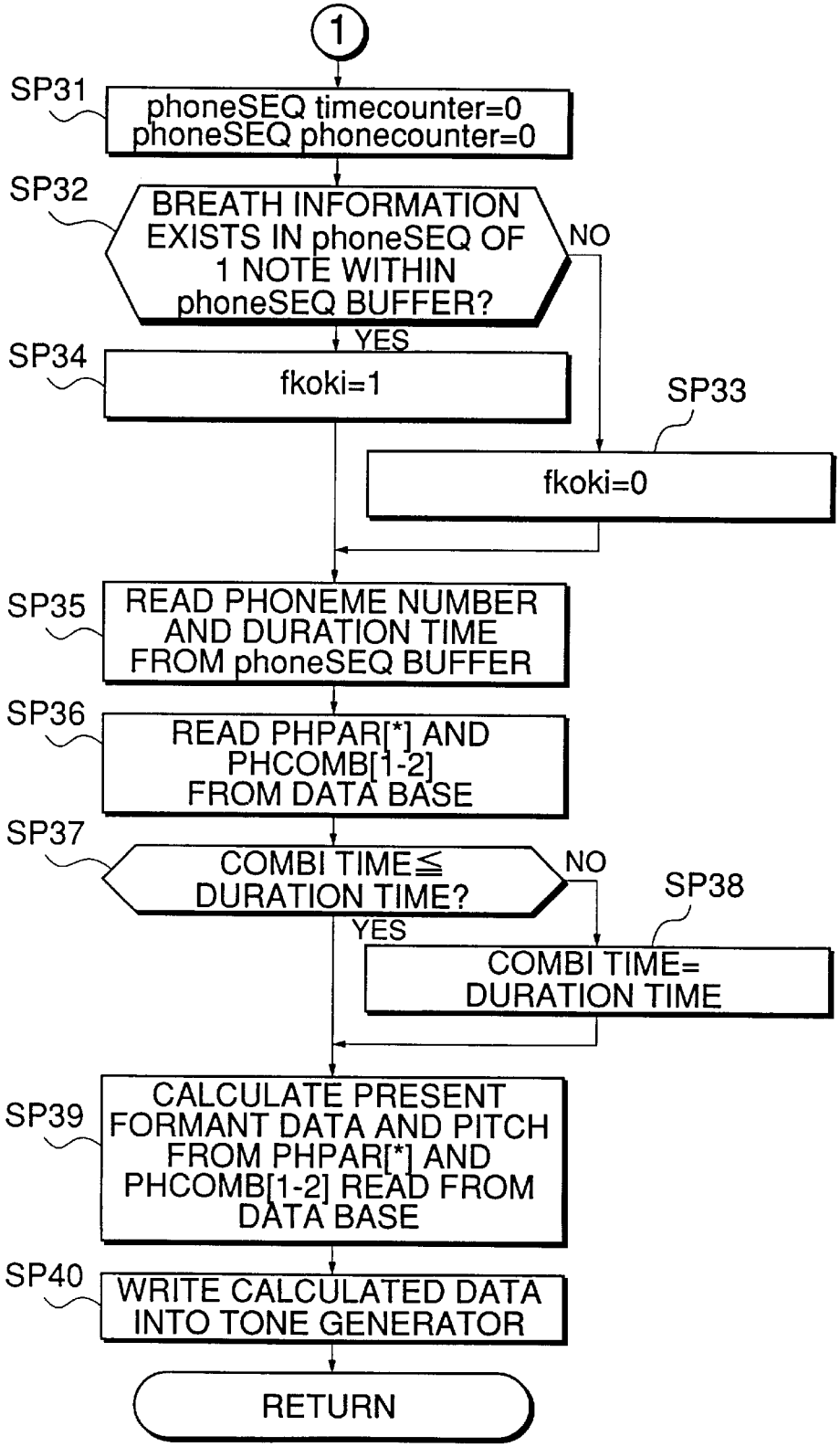
FIG. 7 is a flowchart showing a subroutine for executing a note-on process included in the performance data-processing routine.

Then, when the note-on signal of the instrument sound "E3" is supplied at the time point $t_5$, the note-on process routine shown in FIG. 7 is executed, wherein the parameter sets PHPAR[i] and PHCOMB[a-i] are read out at the step SP36.

Further, since the phoneme "i" is a phoneme to be sounded in response to the note-on signal, similarly to the start of sounding of the phoneme "s", the coarticulation time COMBI TIME of the parameter set PHCOMB[a-i] is compressed or shortened at the step SP39, and accordingly the varying characteristics are compressed along the time axis.

This causes transition of the singing sound generated from the phoneme "a" to the phoneme "i" to take place, whereby the phoneme "i" is brought into a steady state. Thereafter, when a note-on signal is generated which is related to an instrument sound, the phoneme number of the following phoneme and the duration are read out to thereby effect the transition from one singing sound to another.

The phone sequence data can contain various kinds of information other than the kinds described above. One of them is the breath information (indicative of breathing or taking a breath). Now, a process carried out when the phone sequence data contains the breath information will be described.

If a note-on event occurs after the phone sequence data containing the breath information is supplied, the FIG. 7 routine is carried out as described above. Then, at the step SP32, it is determined that the breath information exists within the phone sequence data, whereby the breath flag fkoki is set to "1" at the step SP34.

Thereafter, the same process as carried out in the case of the phone sequence data containing no breath information is carried out. When a note-off event of the instrument sound occurs and the FIG. 8 routine is carried out, it is determined at the step SP57 that the breath flag fkoki assumes "1", whereby a key-off process of the singing sound is carried out at a step SP58.

More specifically, a key-off signal of the singing sound is supplied to the tone generator 4. Then, at the tone generator 4, a release process is carried out, which gently and progressively decreases the level of the singing sound. By this process, no sound is generated during the time interval between the note data being processed and the following note-on data, whereby a singing sound is generated as if the singer were taking a breath.

Next, description will be made of a process carried out when all the phonemes included in one note are to be sounded over durations set to finite values (values other than '00'). In such a case, whenever the FIG. 9 timer interrupt-handling routine is carried out, the variable phoneSEQtime counter is incremented at the step SP64, and when the same routine is started next time, the value of the variable is compared with the duration of the phoneme being sounded at the step SP63.

Then, when it is determined at the step SP63 that the variable phoneSEQtime counter is within the duration, the program proceeds to the step S67, wherein the variable phoneSEQphone counter is incremented. Then, when the duration for the last phoneme has elapsed, the variable phoneSEQphone counter and the variable phone number becomes equal to each other, so that the answer to the question of the step SP68 becomes negative (NO), and then the program proceeds to a step SP71.

At the step SP71, a key-off process of the singing sound is carried out. More specifically, a key-off signal of the singing sound is supplied to the tone generator 4, whereby no sound is generated during the time interval between the note data being sounded and the following note-on data. Such a finite duration is suitable for generating a singing sound staccato or intermittently.

Next, a case where another phoneme follows a phoneme whose duration is set to "0" will be described.

The case where another phoneme follows a phoneme whose duration is set to "0" includes, for instance, a case where one note contains the phonemes "s", "a" and "t" in the mentioned order and the duration of "a" is set to '00' and the duration of "s" and that of "t" are set to respective finite values.

In such a case, when a note-off event of a corresponding instrument sound occurs to thereby start the FIG. 8 routine, it is determined at the step SP51 that another phoneme exists after the phoneme whose duration is set to "0", and then the program proceeds to a step SP52, wherein the variable phoneSEQphone counter is set to a value indicating a phoneme immediately following the phoneme whose duration is set to "0".

In the above example (phonemes "s", "a", and "t"), the variable phoneSEQphone counter is set to "2" which indicates the phoneme "t". Further, at the step SP52, the variable phoneSEQtime counter is set to "0".

Then, the program proceeds to a step SP53, wherein from the area phoneSEQbuffer, the phoneme number of the following phoneme and the duration thereof are extracted. That is, in the above example, the phoneme number of "t" and the duration thereof are read out.

The program then proceeds to a step SP54, wherein the parameter set PHPAR[*] and the parameter set PHCOMB [1-2] are read out from the data base within the ROM 7 according to the preceding and following phonemes. In this example, the parameter set PHPAR[t] and the parameter set PHCOMB[a-t] are read out.

Then, at the following step SP55, according to the varying characteristics contained in these parameters, the formant data are calculated according to the current value of the variable phoneSEQtime counter ("0" in the present case). Then, at the step SP56, the calculated formant data are written into the channels of the tone generator for singing sounds, whereby transition from the phoneme "a" to the phoneme "t" starts to take place.

Then, at the step SP59, the key-off process of the instrument sound is carried out. Thereafter, the FIG. 9 timer interrupt-handling routine is repeatedly carried out to effect transition from the phoneme "a" to the phoneme "t" and then the phoneme "t" is sounded in a steady state.

When the duration of the last phoneme has elapsed, the variable phoneSEQphone counter and the variable phone number become equal to each other, so that the answer to the question of the step SP68 becomes negative (NO), and accordingly the program proceeds to the step SP71, wherein the key-off process of the singing sound is carried out.

As described above, when one phoneme ("a" in the above example) is followed by another phoneme ("t" in the same) whose duration is set to "0", the sounding of the latter is started at timing of occurrence of a note-off of the following instrument sound. This make it possible to complete sounding of all the phonemes of one note before occurrence of a note-on of the following instrument sound, except special cases, e.g. where the duration of "another phoneme" is extremely long or a time period before the occurrence of the note-on of the following instrument sound is extremely short.

The invention is not limited to the embodiment described above, but many variations including ones described below are possible.

1. Although in the above described embodiment, when phone sequence data contains breath information, a key-off process of a singing sound is carried out upon note-off of an instrument sound (steps SP57 and SP58 in FIG. 8), this is not limitative, but a breath sound (sound which sounds like breathing of the singer) may be generated before the key-off process.

2. Although in the above described embodiment, the tone generator 4 has four channels provided for each voiced sound and four channels provided for each unvoiced sound, this is not limitative, but for phonemes which have lots of high-frequency components, such as the phoneme "s", additional channels may be assigned thereto to thereby form formants suitable for high frequency components. In FIGS. 10 and 11, "TGf5" and "UTG5" designate the frequencies and formant levels of such additional formants.

3. Although in the above embodiment, as the coarticulation time COMBI TIME, a common value is used for all the formants, this is not limitative, but different values may be employed for respective formants. Further, the start of transition may be made different between the formants.

4. Although in the above embodiment, as an example of reducing the rise time of a vocal sound signal, the technique of varying the formant levels as shown in FIG. 14C is employed, this is not limitative, but various other methods of reducing the rise time of vocal sound signals may be employed, instead.

Next, a second embodiment of the invention will be described with reference to FIGS. 15 to 27.

Figure 15:
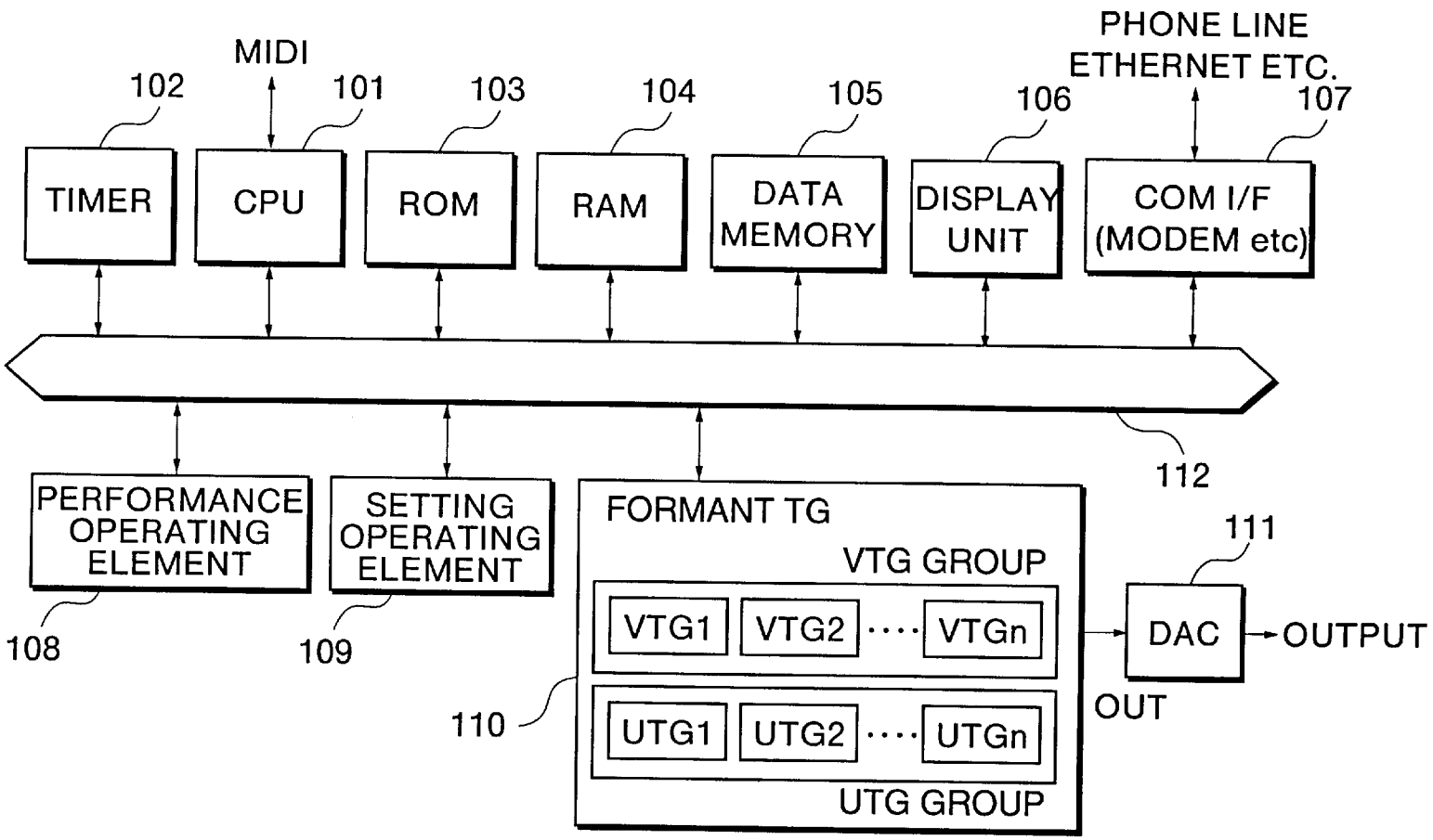
FIG. 15 is a block diagram showing the arrangement of an electronic musical instrument incorporating a musical sound synthesizer according to a second embodiment of the invention.

FIG. 15 shows the whole arrangement of an electronic musical instrument incorporating an musical sound synthesizer according to a second embodiment of the invention. The electronic musical instrument is comprised of a central processing unit (CPU) 101, a timer 102, a read only memory (ROM) 103, a random access memory (RAM) 104, a data memory 105, a display unit 106, a communication interface (I/F) 107, a performance operating element 108, a setting operating element 109, a formant-synthesizing tone generator (FORMANT TG) 110, a digital/analog converter (DAC) 111, and a bus 112 which is a bidirectional type connecting the components 101 to 110 to each other.

The CPU 101 controls the overall operation of the electronic musical instrument. Especially, it is capable of sending and receiving MIDI messages to and from an external device. The timer 102 generates a timer interrupt signal at time intervals designated by the CPU 101. The ROM 103 stores control programs which are executed by the CPU 101 (details of which will be described hereinafter with reference to FIGS. 19 to 22), data of various constants, etc. The RAM 104 has a program load area for temporarily storing control programs read from the ROM 103 for execution by the CPU 101, a working area used by the CPU 101 for processing data, a MIDI buffer area for storing MIDI data, etc.

The data memory 105 stores song data including performance information and lyrics information, and can be implemented by a semiconductor memory device, a floppy disk drive (FDD), a hard disk drive (HDD), a magneto-optic (MO) disk, an IC memory card device, etc. The display unit 106 is comprised of a display arranged on a panel of the electronic musical instrument and a drive circuit for dividing the display, and displays various kinds of information on the display. The communication I/F 107 provides interface between the electronic musical instrument and a public line, such as a telephone line, and/or a local area network (LAN), such as Ethernet.

The performance operating element 108 is implemented, by a keyboard having a plurality of keys which the user operates to play the instrument, but it may be implemented by another kind of operating element. The setting operating element 109 includes operating elements, such as various kinds of switches arranged on the panel. The formant-synthesizing tone generator 110 generates vocal sounds having designated formants at pitches designated according to instructions (formant parameters) from the CPU 101. Details of the formant-synthesizing tone generator will be described hereinafter with reference to FIG. 16. Vocal sound signals delivered from the formant-synthesizing tone generator 110 are converted by the DAC 111 into analog signals, and then sounded by a sound system, not shown.

The electronic musical instrument is capable of generating singing sounds according to the song data loaded from the data memory 105 into the RAM 103, or lyrics data and performance data received in MIDI format. Further, lyrics data and performance data may be formed in the RAM 104 or the data memory 105 by the use of the performance operating element 108 and the setting operating element 109, and singing sounds may be generated from the data thus formed. Alternatively, lyrics data may be provided in advance in the RAM 104 by inputting the same using the setting operating element 109, or by receiving the same in MIDI format from an external device, or by reading the same from the data memory 105, and then the lyrics data may be sounded such that they are sounded at pitches designated by performance data input by the performance operating element 108. As the lyrics data and performance data, there may be used data received via the communication I/F 107.

The lyrics data and performance data may be provided in any suitable manner including ones mentioned above. For simplicity of explanation, the following description will be made of a case where the lyrics data and performance data (e.g. song data as input data (1) used when the phonemes "saita" are sounded at pitches corresponding to notes C3, E3, and G3 described under the heading of Prior Art) are received in MIDI format, and based on the received data, the CPU 101 gives instructions (e.g. formant parameters) to the formant-synthesizing tone generator 110 to thereby generate singing sounds.

Figure 16A:
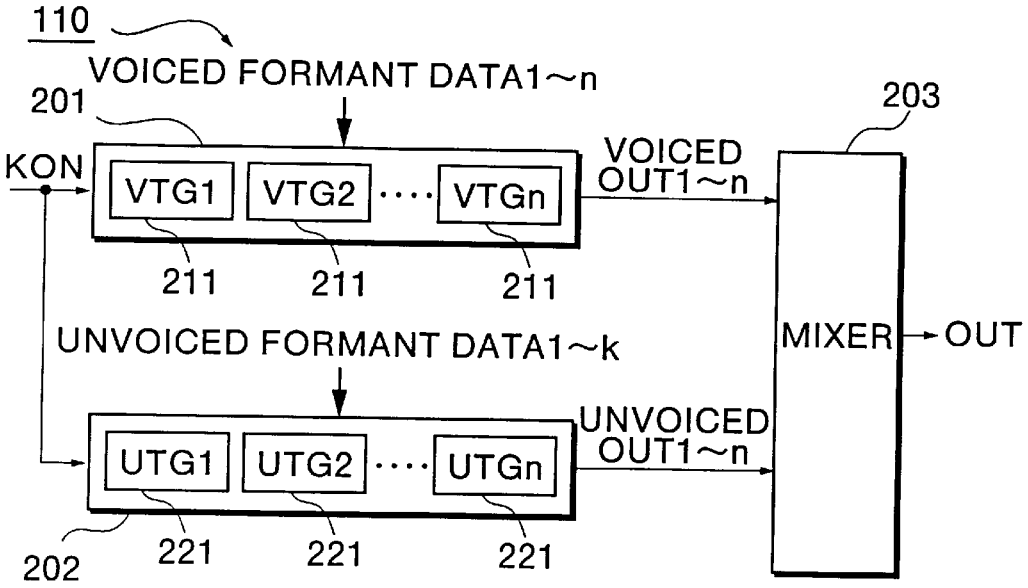
FIGS. 16A to 16C are diagrams showing the arrangements of blocks of a formant-synthesizing tone generator 110 appearing in FIG. 15.

FIG. 16A schematically shows the arrangement of the formant-synthesizing tone generator 110. The formant-synthesizing tone generator 110 is comprised of a VTG group 201, a UTG group 202, and a mixer 203. The VTG group 201 is comprised of a plurality of (n) voiced sound generator units VTG1, VTG2, . . . VTGn for generating respective vowel formant components having pitches. The UTG group 202 is comprised of a plurality of (n) unvoiced sound tone generator units UTG1, UTG2, . . . UTGn for generating noise-like components contained in a vowel and consonant formant components. When a vocal sound is synthesized, for each of the vowel and the consonant, a corresponding combination of tone generator units VTG's or UTG's corresponding in number to the number of the formants of the vowel or the consonant are used to thereby generate vocal sound components for synthesis of the vocal sound (refer e.g. to Japanese Laid-Open Patent Publication (Kokai) No. 3-200300). Voiced sound outputs (VOICED OUT1 to VOICED OUTn) from the tone generator units VTG1 to VTGn and unvoiced sound outputs (UNVOICED OUT1 to UNVOICED OUTn) from the tone generator units UTG1 to UTGn are mixed by the mixer 203 to generate the resulting output. This enables a musical sound signal having the designated formants to be generated.

Figure 16B:
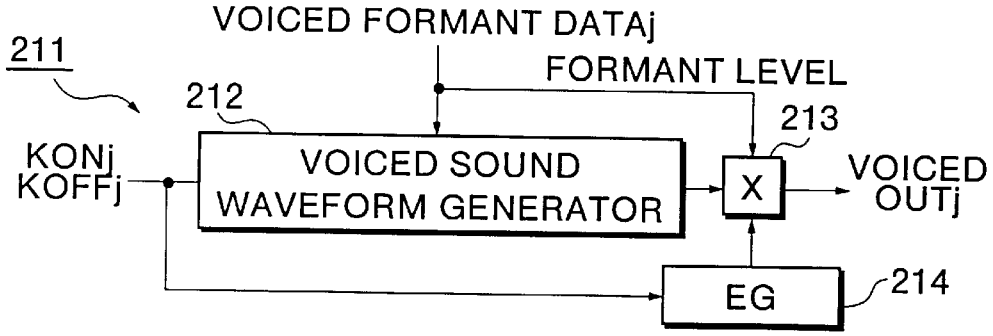

FIG. 16B schematically shows the construction of a voiced sound tone generator unit VTGj (j is an integer within a range of 1 to n) 211 for forming a voiced sound waveform. The tone generator units VTG1 to VTGn are all identical in construction. The tone generator unit VTGj 211 is comprised of a voiced sound waveform generator 212, a multiplier 213, and an envelope generator (EG) 214. As the EG 214, a hardware EG is used.

A key-on signal KONj and a key-off signal KOFFj delivered from the CPU 101 (the key-on signal and key-off signal to the tone generator VTGj are represented respectively by KONj and KOFFj) are input to the voiced sound waveform generator 212 and the EG 214. Formant parameters (VOICED FORMANT DATAj delivered from the CPU 101 at time intervals of 5 milliseconds are supplied to the voiced sound waveform generator 212. These formant parameters are used for generating a voiced sound, and define a formant center frequency, a formant shape, and a formant level of a formant of the voiced sound to be generated. Of the formant parameters, the formant level is input to the multiplier 213. The multiplier 213 is supplied with waveform data from the voiced sound waveform generator 212 and an envelope waveform from the EG 214.

Figure 17:
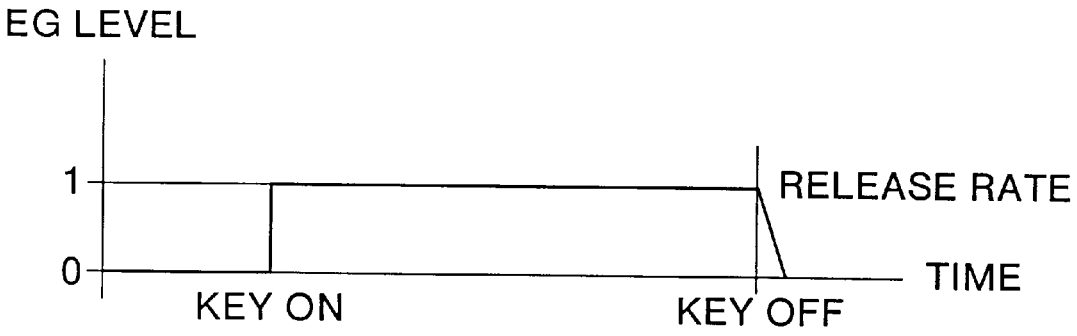
FIG. 17 is a diagram showing an envelope waveform.

Now, the operation of the tone generator unit VTGj 211 will be described. The whole tone generator unit operates on a sampling clock having a predetermined sampling frequency (e.g. 44 KHz). When the key-on signal KONj is received from the CPU 101, the voiced sound waveform generator 212 generates voiced sound waveform data at time intervals of the sampling repetition period according to the formant parameters (VOICED FOMMANT DATAj) delivered from the CPU 101. In other words, the voided sound waveform generator 212 generates a waveform of a voiced sound, which has the formant center frequency and formant shape thereof defined by the formant parameters. Further, the EG 214 generates data of an envelope waveform as shown in FIG. 17, at time intervals of the sampling repetition period, in response to the key-on signal KONj. As shown in FIG. 17, the envelope waveform rises from a level "0" to a level "1" when the key-on signal is received, and during key-on (i.e. basically during generation of the singing sound), the level "1" is preserved. Upon receipt of the key-off signal, the level is caused to fall at a predetermined release rate to the level "0". The multiplier 213 multiplies the waveform data delivered from the voiced sound waveform generator 212 by the formant level of the formant parameters and the envelope waveform delivered from the EG 214, and outputs the resulting product as the voiced sound waveform data (VOICED OUTj) at time intervals of the sampling repetition period.

As shown in FIG. 17, during key-on (during generation of the singing sound), the EG 213 outputs the envelope waveform at the level "1", so that the delivered voiced sound waveform data (VOICED OUTj) has a value substantially equal to the product of (waveform data from the waveform generator 212)×(formant level of the formant parameters). This means that the formant level during key-on is controlled by (the value of the formant level of) the formant parameters supplied from the CPU 101. The CPU 101 generates the formant level at time intervals of 5 milliseconds, and hence the level control is effected at time intervals of 5 milliseconds. The time period of 5 milliseconds is much longer than the sampling repetition period. However, to obtain normal characteristics of vocal sounds, it suffices to generate the formant parameters at time intervals of 5 milliseconds.

On the other hand, when the key-off signal KOFFj is received from the CPU 101, the EG 214 generates data of a portion of the envelope waveform which falls at the predetermined release rate as shown in FIG. 17, at time intervals of the sampling repetition period. Further, after the key-off, the CPU 101 delivers formant parameters every 5 milliseconds to execute sounding after the key-off, with the formant level of the parameters being fixed to a value assumed at the time point of the key-off. Since the formant level given as part of the formant parameter is a fixed value, the voice sound waveform data (VOICED OUTj) delivered has a value equal to the product of (waveform data from the waveform generator 212)×(fixed value of the formant level at the time point of key-off)×(envelope waveform from EG214). This means that the output level of a formant of the voiced sound after the key-off is controlled by the envelope waveform delivered from the EG 214. Since the EG 214 generates data of the envelope waveform (a fall portion of the waveform after the key-off shown in FIG. 17) at time intervals of the sampling repetition period, the output level of the formant is controlled at such short time intervals (at a faster rate compared with a rate corresponding to the time intervals of outputting of the formant parameters).

Figure 16C:
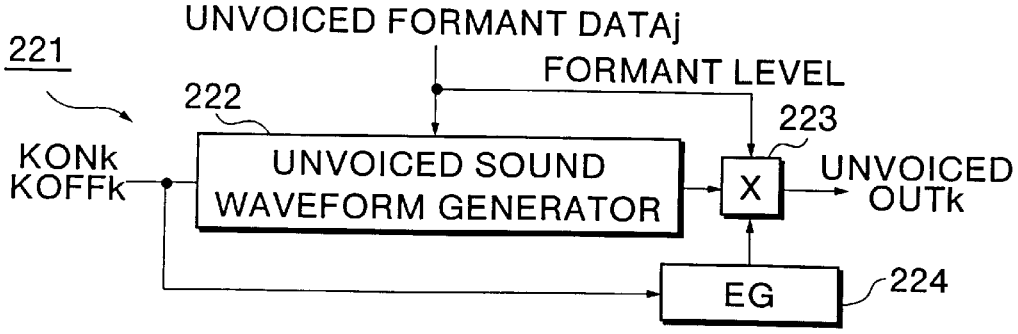

FIG. 16C schematically shows the arrangement of an unvoiced sound tone generator unit UTGk (k represents an integer within a range of 1 to n). The tone generator units UTG1 to UTGn are all identical in construction. The tone generator unit UTGk 221 is comprised of an unvoiced sound waveform generator 222, a multiplier 223, and an EG 224. The unvoiced sound waveform generator 222 generates unvoiced sound waveform data according to formant parameters (UNVOICED FROMANT DATAk) delivered from the CPU 101 for generating an unvoiced sound. The EG 224 is similar in construction to the EG 214, and generates an envelope waveform as shown in FIG. 17.

The same description as that of the tone generator unit VTGj for generating voiced sound waveforms made above with reference to FIGS. 16B and 17 applies to the tone generator unit UTGk for generating unvoiced sound waveforms. In other words, in the above description of the tone generator unit VTGj, the terms "VTGj", "VTG", "voiced sound waveform generator 212", "the multiplier 213", "EG 214", "KONj", "KOFFj", "formant parameters (VOICED FORMANT DATAj)", and the "VOICED OUTj" should be read as "UTGj", "UTG", "unvoiced sound waveform generator 222", "the multiplier 223", "EG 224", "KONk", "KOFFk", "formant parameters (UNVOICED FORMANT DATAk)", and the "UNVOICED OUTk". Particularly, the tone generator unit UTGk is similar to the tone generator unit VTGj in that when the key-on signal (KONk) is received, the output level of a formant of the unvoiced sound is controlled according to the formant level of the formant parameters received from the CPU 101 at time intervals of 5 milliseconds to deliver the unvoiced sound waveform data (UNVOICED OUTk), while upon receipt of the key-off signal (KOFFk), the output level of the formant of the unvoiced sound is controlled by the envelope waveform delivered from the EG 224 at time intervals of the sampling repetition period.

To generate a singing sound of a voiced sound, a plurality of (basically four, since the singing sound is generated normally based on the four formants) of the tone generator units VTGj for generating voiced sound waveforms are used, while to generate a singing sound of an unvoiced sound, a plurality of (basically four, since the singing sound is generated normally based on the four formants) of the tone generator units UTGk for generating unvoiced sound waveforms are used. Each of the individual tone generator units will be called "formant sounding channel" (or simply "channel")hereafter. Details of the arrangement of the tone generator unit VTGj is disclosed e.g. in Japanese Laid-Open Patent Publication (Kokai) No. 2-254497, while details of the arrangement of the tone generator unit UTGj is disclosed e.g. in Japanese Laid-Open Patent Publication (Kokai) No. 4-346502. The control system of the electronic musical instrument is disclosed e.g. in Japanese Laid-Open Patent Publication (Kokai) No. 4-251297.

Figure 18A:
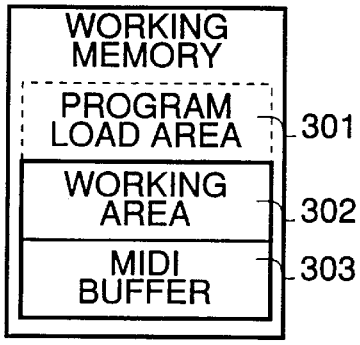
FIGS. 18A to 18E are diagrams showing various kinds of data and various kinds of data areas in a ROM 103 and a RAM 104 appearing in FIG. 15.

FIGS. 18A to 18E show various kinds of data and various kinds of data areas. First, FIG. 18A shows a memory map of the whole RAM 104. As shown in the figure, the RAM 104 is divided into a program load area 301 into which a control program stored in the ROM 103 is loaded, a working area 302 which is used in executing programs (described in detail hereinafter with reference to FIGS. 19 to 22) loaded in the program load area 301, and for storing various kinds of flags, and a MIDI buffer 303 for temporarily storing MIDI messages received by the CPU 101. The MIDI buffer 303 is used as a buffer for temporarily storing lyrics data received before a note-on when song data of the sequence (1) as described under the heading of Prior Art is received (identical to the lyrics information buffer 1305 shown in FIG. 1).

Figure 18B:
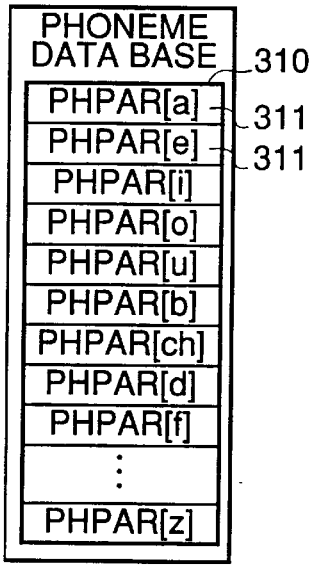

FIG. 18B shows a phoneme data base 310 provided in the ROM 103. The phoneme data base 310 is a collection of formant parameter data 311 set for each phoneme. PHPAR [*] designates a formant parameter set of a phoneme [*]. The phoneme data base 310 may be fixedly stored in the ROM 103, or may be read from the ROM 103 into the RAM 104, or may be used by reading phoneme data base provided separately in any of various kinds of suitable storage media and loading the same into the RAM 14. These formant parameters determine vocal sound characteristics (differences between individuals, male voice, female voice, etc.), and a plurality of phoneme data bases corresponding to respective vocal sound characteristics may be provided for selective use.

Figure 18C:
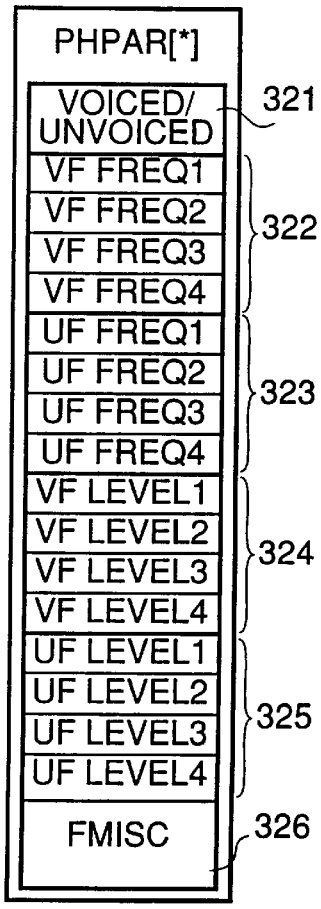

FIG. 18C shows details of the formant parameter set PHPAR[*] related to one phoneme stored in the phoeneme data base 310. Reference numeral 321 designates information VOICED/UNVOICED designating whether the present phoneme[*] is a voiced sound or an unvoiced sound. Reference numerals 322, 323, 324, and 325 designate pieces of information related to the phoneme, similar to those shown in FIG. 12A, i.e. formant center frequencies (VF FREQ1 to VF FREQ4) of a voiced sound component, formant frequencies of (UF FREQ1 to UF FREQ4) of an unvoiced sound component, formant levels (VF LEVEL1 to VF LEVEL4) of the voiced sound component, and formant levels (UF LEVEL1 to UF LEVEL4) of the unvoiced component, respectively. When the phoneme is an unvoiced sound, the formant levels (VF LEVEL1 to VF LEVEL4) of the voiced component 324 are all set to "0" (or may be ignored during processing). Reference numeral FMISC 326 designates other formant-related data.

Although in the present embodiment, the number of formants is assumed to be four, this is not limitative, but it may be set to a desired number according to the specification of the control system of the electronic musical instrument employed. Since the number of formants is equal to 4, each of the parameter data 322 to 325 is divided into four parameter values. For example, the parameter data of the formant frequencies of a voiced sound component 322 is divided into four parameter values, i.e. a center frequency data VF FREQ1 of a first formant, a center frequency data VF FREQ2 of a second formant, a center frequency data VF FREQ3 of a third formant, and a center frequency data VF FREQ4 of a fourth formant. The other parameter data 323 to 325 are also divided in the same manner.

The data of formant frequency and formant level of each formant are time-series data which can be sequentially delivered at time intervals of 5 milliseconds and have values corresponding to respective different sounding time points. For instance, the center frequency data VF FREQ1 of the first formant of the voiced sound is a collection of data values each of which is to be delivered at time intervals of 5 milliseconds. This time-series data, however, includes a looped portion, and hence when the sounding time is long, the data of the looped portion is repeatedly used.

Figure 18D:
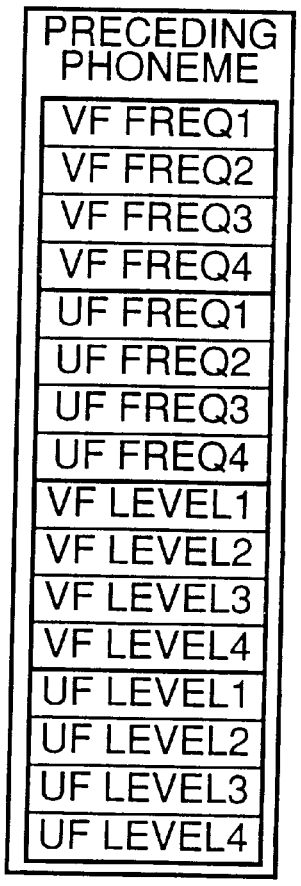
Figure 18E:
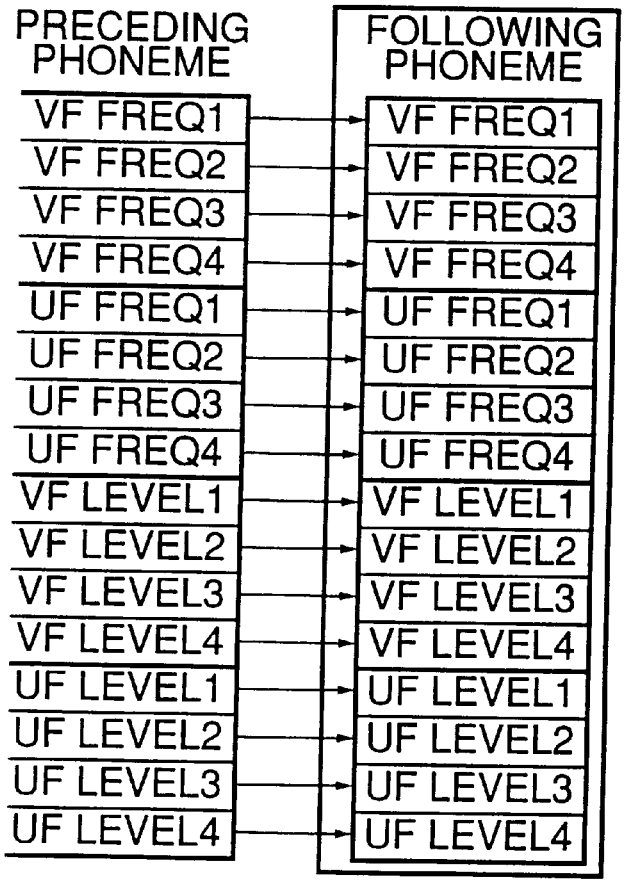

FIG. 18D shows a manner of an interpolation carried out on the formant center frequencies and formant levels of the formant parameters for transition from a preceding phoneme to a following phoneme. In a case of a transition from one voiced sound to another voiced sound, a case of a transition from one unvoiced sound to another unvoiced sound, and a case of a transition from one unvoiced sound to one voiced sound, the CPU 101 carries out an interpolation, as shown in FIG. 18D, to sequentially generate intermediate values of formant center frequency and formant level progressively shifting from the values of formant center frequency and formant level of the preceding phoneme to the values of formant center frequency and formant level of the following phonemes, at time intervals of 5 milliseconds, and deliver the same to the formant-synthesizing tone generator 110. This makes it possible to carry out a smooth transition from one phoneme to another. The interpolation can be carried out by any suitable known method, and in the present embodiment, it is carried out with reference to a coarticulation data base, not shown.

On the other hand, a transition from one voiced sound to one unvoiced sound, which forms an essential feature of the present invention, is carried out without employing the method of the FIG. 18D interpolation. In the present embodiment, a voiced sound is generated by the voiced sound tone generator unit for generating voiced sound waveforms, while an unvoiced sound is generated by the unvoiced sound tone generator unit for generating unvoiced sound waveforms. Therefore, to carry out a transition from the voiced sound to the unvoiced sound, it is required that the voiced sound tone generator unit quickly damps or attenuates the level of the voiced sound component of the preceding phoneme, while the unvoiced sound tone generator unit quickly increases the level of the unvoiced sound component of the following phoneme. Since the voiced sound tone generator unit and the unvoiced sound tone generator unit are separate units of the formant-synthesizing tone generator unit, it is impossible to continuously shift the voiced sound to the unvoiced sound. Particularly, to quickly damp the level of the voiced sound, the rate of supply of the formant level by the formant-synthesizing tone generator at time intervals of 5 milliseconds is too low to properly update the formant level, resulting in a momentary discontinuity in the generated waveform and hence noise in the generated sound. On the other hand, if the formant level is smoothly decreased so as not to generate noise, it takes much time and quick damping of the formant level cannot be effected.

To solve this problem, in the present embodiment, in transition from a voiced sound to an unvoiced sound, a fall in the level of the voiced sound component of the preceding phoneme is realized by the EG within the formant-synthesizing tone generator. That is, the EG operates on the sampling frequency to deliver an envelope waveform at time intervals of the sampling repetition period, i.e. at a rate faster than the rate of updating of formant parameters. This enables the voiced sound to be smoothly and quickly damped, while avoiding noise resulting from a discontinuity in the generated waveform. When a transition is effected from an unvoiced sound to a voiced sound, delivery of formant parameters to the formant-synthesizing tone generator at time intervals of 5 milliseconds does not cause noise ascribable to a discontinuity in the generated waveform, which is appreciable to the human sense of hearing. Therefore, in the present embodiment, even the transition from an unvoiced sound to a voiced sound is realized by delivering parameters generated by an interpolation as shown in FIG. 18D to the tone generator at time intervals of 5 milliseconds.

Figure 19:
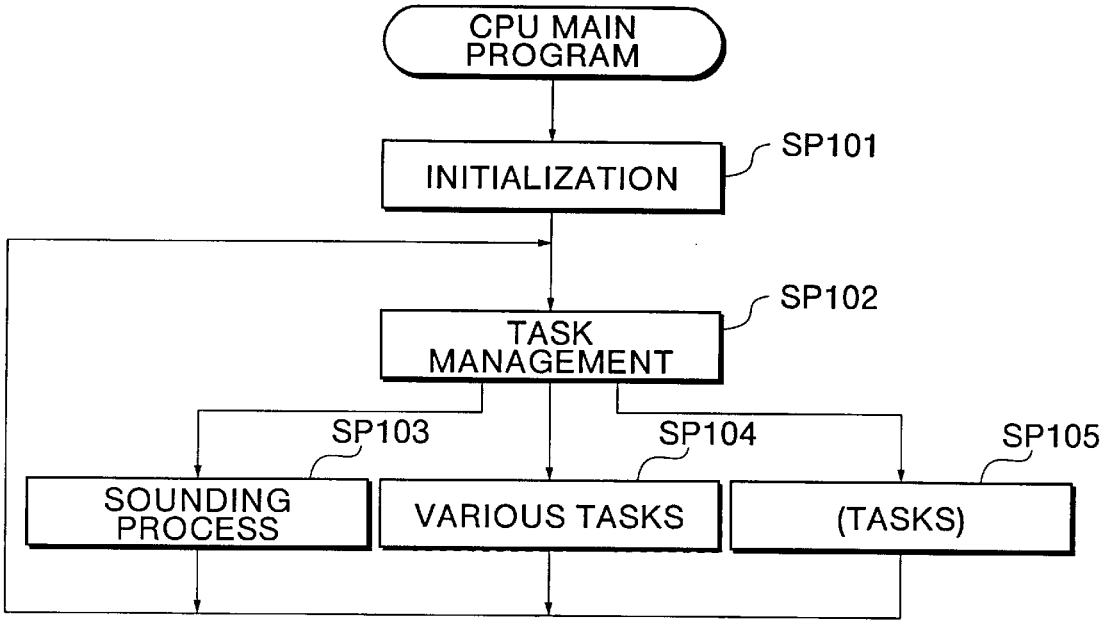
FIG. 19 is a flowchart showing a main program executed by the second embodiment.

FIG. 19 shows a main program which is executed by the CPU 101 when the power of the electronic musical instrument is turned on. First, at a step SP101, various kinds of initializations are carried out. Particularly, a note-on flag NOTEONFLG and a damp flag DAMPFLG, hereinafter referred to, are initialized to a value of "0". Then, at a step SP102, task management is carried out. According to this processing, one task is switched to another for execution depending on operating conditions of the system. Particularly, when a note-on event or a note-off event has occurred, a sounding process at a step SP103 is carried out. Then, at a step SP104 and a step SP105, various kinds of tasks are carried out depending on operating conditions of the system. After execution of these tasks, the program returns to the task management at the step SP102.

Figure 21:
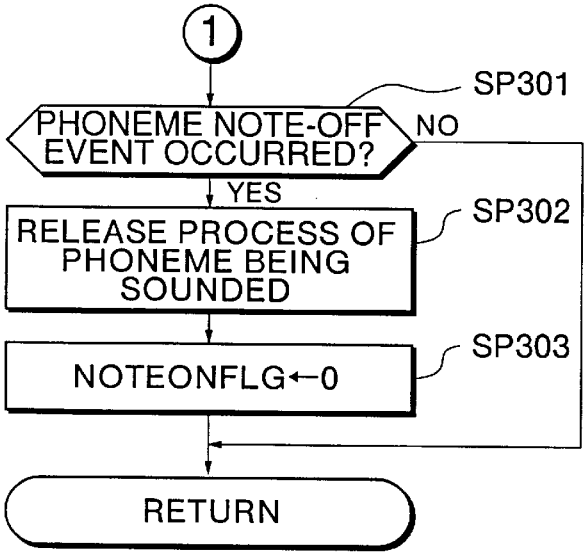
FIG. 21 is a continued part of the flow of FIG. 19.
Figure 20:
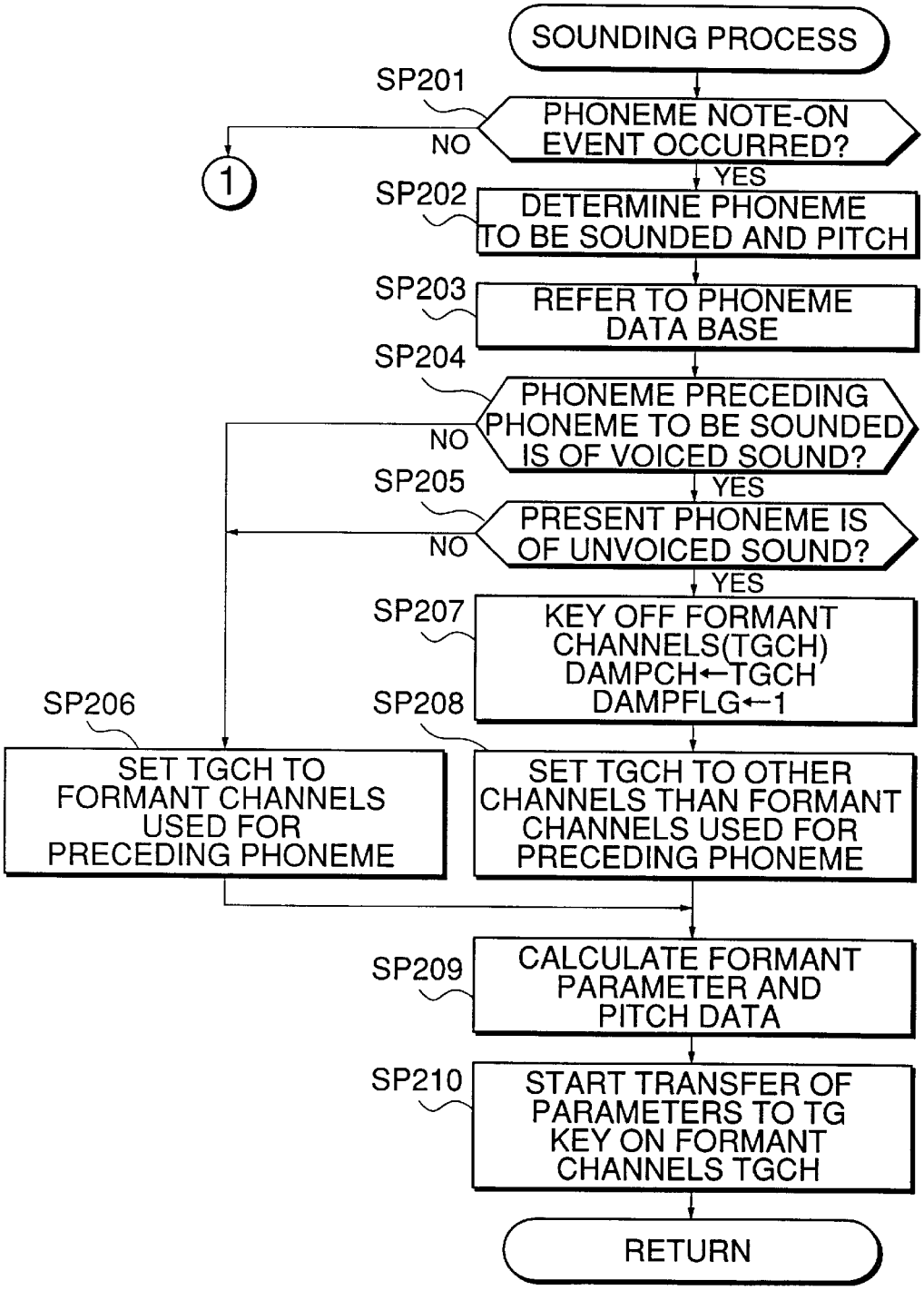
FIG. 20 is a flowchart showing a sounding process routine executed by the second embodiment.

Now, the sounding process routine executed at the step SP163 will be described with reference to FIGS. 20 and 21. FIG. 20 shows a sounding process routine executed at the step SP103 when a note-on event or a note-off event has occurred. FIG. 21 shows a routine branching off from a step SP201 of FIG. 20.

First, at the step SP201, it is determined whether or not a phoneme note-on event has occurred. This phoneme note-on event takes place after lyrics data received in advance has been stored in the MIDI buffer 303 (see FIG. 18A), as in the case of the sequence (1) described hereinbefore under the heading of Prior Art. In this connection, the unit of note-on is not necessarily limited to a single phoneme, but can be a syllable of the Japanese syllabary, such as "sa" or "ta". If it is determined at the step SP201 that a phoneme note-on event has occurred, the program proceeds to a step SP202, wherein a phoneme to be sounded in response to the note-on event and a pitch therefor are determined. The phoneme is determined from lyrics data stored in the MIDI buffer 303 and the pitch is determined from pitch data contained in the note-on data. Then, at a step SP203, formant parameters of the phoneme to be sounded are read from the phoneme data base 310 (FIG. 18B).

Then, at a step SP204, it is determined whether or not the preceding phoneme is a voiced sound. If it is determined at the step SP204 that the preceding phoneme is a voiced sound, it is determined at a step SP205 whether or not the phoneme for which the present note-on has occurred is an unvoiced sound. If it is determined that this phoneme is an unvoiced sound, the program proceeds to a step SP207, whereas if it is determined that the same is not an unvoiced sound, the program proceeds to a step SP206. If it is determined at the step SP204 that the preceding phoneme is not a voiced sound, the program proceeds to the step SP206. That is, from the steps SP204 and SP205, the program branches to the step SP207 et seq. only when the phoneme being sounded before the present note-on event is a voiced sound and the phoneme of the present note-on event is an unvoiced sound, but otherwise the program branches to the step SP206 et seq. It should be noted that if there is no phoneme sounded before the present note-on event, the program proceeds from the step SP204 to the step SP206.

At the step SP206, the same channels as those used for generating a sound of the phoneme sounded before the present note-on are set to a TGCH register for formant channels TGCH. The TGCH register stores information specifying sounding channels for use in the present sounding (more specifically, several tone generator units VTG211 of the VTG group 201 which are selected for use in the sounding, and several tone generator units UTG221 of the UTG group 211 which are selected for use in the sounding). Therefore, in the present case, a value of the TGCH register is not changed. It should be noted that if there is no phoneme being sounded before the present note-on, channels are newly assigned to the formant channels TGCH. From the step SP206, the program proceeds to the step 209.

If it is determined that the phoneme being sounded before the present note-on is a voiced sound and the phoneme of the present note-on event to be sounded is an unvoiced sound, key-off signals KOFF are sent to the formant channels TGCH being used for sounding. In response to the key-off signals KOFF, as described hereinbefore with reference to FIG. 16B, the EG 214 of each tone generator unit VTG 211 operates to decrease the level of the envelope waveform, thereby starting the damping of the voiced sound being generated. Further, at this step SP207, the value of the TGCH register is temporarily stored in a DAMPCH register and a damp flag DAMPFLG is set to "1". The DAMPCH register is for storing information on channels for which the EG started the damping of the sound being sounded. The damp flag DAMPFLG, when set to "1", indicates that there are channels being damped, and, when reset to "0", indicates that there is no channel being damped. At a step SP208 following the step SP207, channels other than the formant channels of the tone generator currently in use (which are being damped) are newly assigned to the formant channels TGCH. From the step SP208, the program proceeds to a step SP209.

At the step SP209, from the data read at the step SP203, formant parameters and pitch data are calculated in advance. Then, at a step SP210, transfer of the formant parameters of the present phoneme to the formant-synthesizing tone generator 110 is started. This causes the timer 102 to be started to deliver a timer interrupt signal to the CPU 101 at time intervals of 5 milliseconds. By the timer interrupt-handling routine (hereinafter described in detail with reference to FIG. 22) executed in response to each timer interrupt signal, the formant parameters are actually transferred to the channels of the formant tone generator. Thus, at the step SP210, the sounding channels are actuated according to the information of the formant channels TGCH, thereby starting sounding of the phoneme. Further, at the step SP210, a note-on flag NOTEONFLG is set to "1", followed by terminating the program. The note-on flag NOTEONFLG is for indicating a note-on state (when set to "1", it indicates the note-on state, while when set to "0", it indicates otherwise.)

When it is determined at the step SP201 that no phoneme note-on event has occurred, the program proceeds to a step SP301 in FIG. 21, wherein it is determined whether or not a phoneme note-off event has occurred. If it is determined that a phoneme note-off event has occurred, release of the phoneme being sounded is started at a step SP302. This is effected by delivering the key-off signals KOFF to the formant channels TGCH, thereby causing the EG of each tone generator unit VTG 211 or UTG 221 to start the release of the sound being generated as described hereinbefore with reference to FIGS. 16A to 16C. The rate of the release can be designated as desired in a manner dependent upon the delivery of the key-off signals. Then, at a step SP303, the note-on flag NOTEONFLG is set to "0", followed by terminating the program. If it is determined at the step SP301 that no phoneme note-off event has occurred, the program is immediately terminated.

Figure 22:
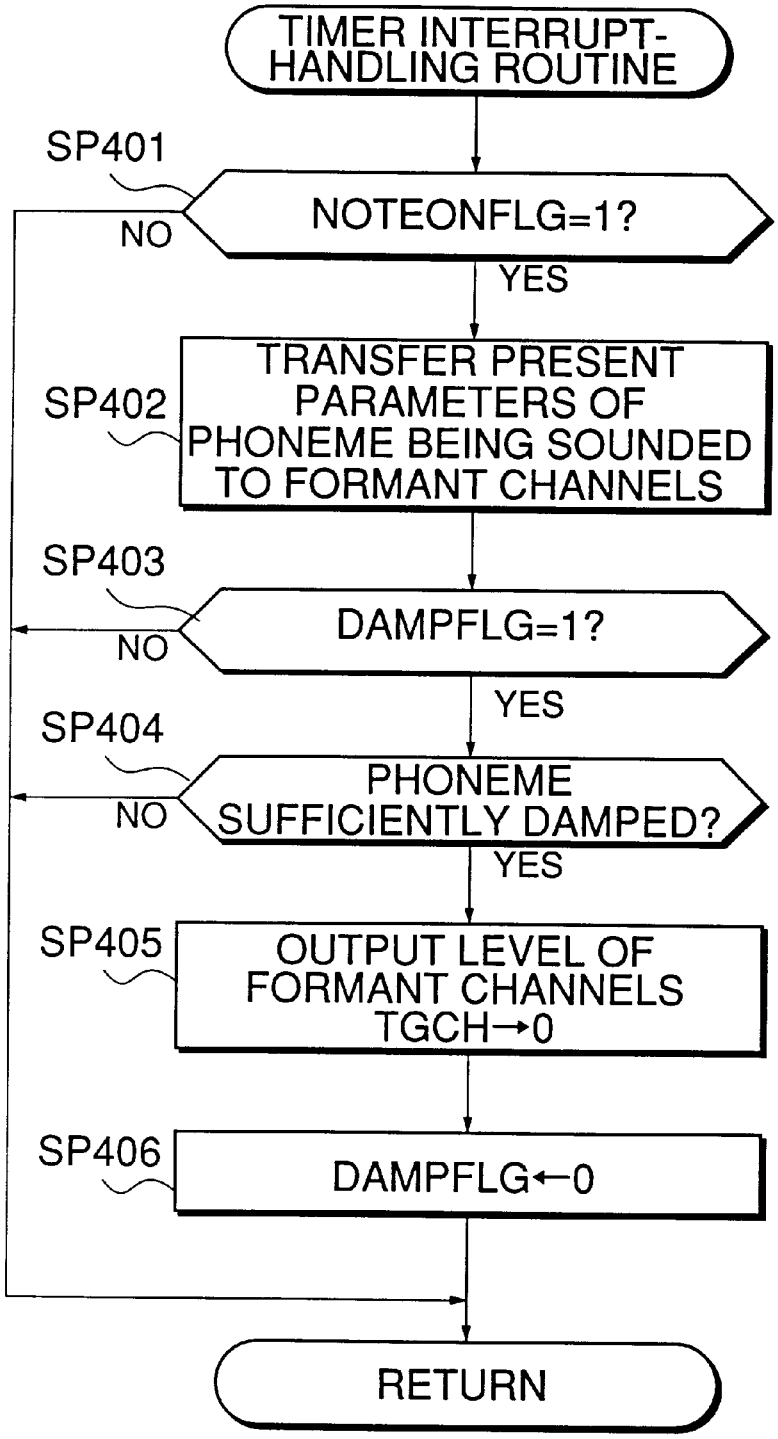
FIG. 22 is a flowchart showing a timer interrupt-handling routine.

FIG. 22 shows a timer interrupt-handling routine 1 executed at time intervals of 5 milliseconds. First, at a step SP401, it is determined whether or not the note-on flag NOTEONFLG assumes "1". If it is determined that the note-on flag NOTEONFLG does not assume "1", it means that no sound is being generated, the program is immediately terminated.

If it is determined that the note-on flag NOTEONFLG assumes "1", then at a step SP402, the formant parameters of the phoneme being sounded at the present time point are calculated and transferred to the formant channels TGCH of the tone generator. This causes the formant parameters to be updated at time intervals of 5 milliseconds. When sounding of a consonant+a vowel of a syllable of the Japanese syllabary is designated, a transition from the consonant to the vowel is effected by the interpolation using the coarticulation data base, as described hereinbefore with reference to FIG. 18D. The calculation of the formant parameters by the interpolation and sending of them to the formant channels TGCH are executed at the step SP402. Similarly, in effecting a transition from a voiced sound to a voiced sound, a transition from an unvoiced sound to an unvoiced sound, or a transition from an unvoiced sound to a voiced sound, the same formant channels TGCH assigned to the preceding phoneme are assigned to the following phoneme, and the calculation of the formant parameters for the formant channels TGCH and sending of the calculated formant parameters to the formant channels TGCH by the interpolation of FIG. 18D are executed at the step SP402. It should be noted that when the successive phonemes are continuously sounded by switching channels, the sounding is carried out by shifting the formant parameters from those of the n-th formant of the preceding phoneme to those of the n-th formant of the following phoneme, which requires execution of the interpolation of FIG. 18D. This interpolation may be executed at the step SP209 in FIG. 20 in place of the step SP402. In this case, at the step SP402, it is only required to send the parameters calculated at the step SP209 to the formant channels TGCH.

Then, at a step SP403, it is determined whether or not the damping flag DAMPFLG assumes "1". If the damping flag DAMPFLG assumes "1", it means that the phoneme being sounded is being damped, and then it is determined at a step SP404 whether or not the phoneme being damped has been sufficiently damped. This determination may be effected by referring to the EG level or output level of the channels on which the phoneme is being damped, or by determining whether a predetermined time period has elapsed after the start of the damping. If it is determined at the step SP403 that the damping flag DAMPFLG does not assume "1", it means that there is no channel on which a phoneme is being damped, and hence the program is immediately terminated. If it is determined at the step SP404 that the level of the phoneme being damped has not been sufficiently damped, the program is immediately terminated to wait for the phoneme to be sufficiently damped. If it is determined at the step SP404 that the phoneme being damped has been sufficiently damped, formant parameters are transferred to cause the output level of channels DAMPCH being damped to be decreased to "0" at a step SP405. In other words, the step SP405 resets to "0" the formant levels of the formant parameters sent to the formant channels of the tone generator, which have been fixed to respective values assumed at the start of the damping. Then, at a step SP406, the damping flag DAMPFLG is reset to "0", followed by terminating the programs.

Next, description will be made of how the processes of FIGS. 19 to 22 described above are executed, by referring to an example thereof. In the electronic musical instrument of the present embodiment, a note-on event or a note-off event occurs when one of various kinds of operating elements is operated or when a MIDI message is received. For simplify of explanation, it is assumed that events take place in the following sequence (1) mentioned hereinbefore under the heading of Prior Art:

s<20>a<0> note-on C3 note-off C3 i<0> note-on E3 note-off E3 t<02>a<00> note-on G3 note-off G3

In the FIG. 19 main routine, when reception of the lyrics data of "s<20>a<a>" is detected at the task management of the step SP102, a corresponding one of various tasks is started at the step SP104, whereby the received lyrics data is stored in the MIDI buffer 303 (FIG. 18A), followed by the program returning to the step SP102. Then, when the "note-on C3" is detected at the step SP102, the sounding process is executed at the step SP103. In the FIG. 20 sounding process routine, to generate a sound of "s<20>a<a>", channels of the tone generator are assigned to the formant channels TGCH and data of the assigned formant channels TGCH is stored in the TGCH register. Then, at the step SP210, the start of transfer of the parameters is instructed. Hereafter, the FIG. 22 timer interrupt-handling routine is executed at time intervals of 5 milliseconds, wherein at the step SP402, the formant parameters are calculated for generating the sound of the "s<20>a<a>" at a pitch corresponding to the note C3 and transferred to the formant channels TGCH, to thereby cause the element of lyrics "sa" to be sounded at the pitch corresponding to the note C3. The following message of "note-off C3" is ignored at the task management of the step SP102 since "a<0>" has been designated.

Then, when reception of the lyrics data "i<0>" is detected at the task management of the step SP102, the data is stored in the MIDI buffer 303 (FIG. 18A), and then the program returns to the step SP102. Then, when reception of the message of "note-on E3" is detected at the step SP102, the sounding process is executed at the step SP103. In the FIG. 20 sounding process routine, the preceding phoneme being sounded is "a" and the present phoneme to be sounded is "i", so that the program proceeds from the step SP205 to the step SP206, wherein the formant channels TGCH assigned for sounding of the phonemes "s<20>a<a>" are used for sounding of the phoneme "i<0>" without any change. Then, at the step SP210, the start of transfer of the parameters is instructed. Hereafter, the FIG. 22 timer interrupt-handling routine is executed at time intervals of 5 milliseconds, wherein the interpolation is carried out at the step SP402 for transition from "s<20>a<a>" to "i<0>" (i.e. a case of transition from a voiced sound to a voiced sound), thereby transferring the calculated formant parameters to the formant channels TGCH. Thus, the transition from "s<20>a<a>" to "i<0>" is effected in a smooth and continuous or coarticulated manner. When a predetermined or sufficient time period has elapsed, the formant parameters delivered at the step SP402 are completely shifted to those of "i<0>", and the sounding of the phoneme "i<0>" is continued. The following message of "note-off E3" is ignored at the task management of the step SP102 since "i<0>" has been designated.

Then, when reception of the lyrics data "t<02>a<00>" is detected at the task management of the step SP102, the data is stored in the MIDI buffer 303 (FIG. 18A), and then the program returns to the step SP102. Then, when reception of the message of "note-on G3" is detected at the step SP102, the sounding process is executed at the step SP103. In the FIG. 20 sounding process routine, the preceding phoneme being sounded is "i" and the present phonemes to be sounded is "ta", so that the program proceeds from the step SP205 to the step SP207, wherein the key-off signals are sent to the formant channels TGCH on which the phoneme "i" is being sounded. Then, at the step SP208, channels different from those currently assigned to the formant channels TGCH are newly assigned to the formant channels TGCH for sounding the phoneme "t<02>a<00>". Then, at the step SP210, the start of transfer of the formant parameters is instructed. Hereafter, the FIG. 22 timer interrupt-handling routine is executed at time intervals of 5 milliseconds, wherein at the step SP402, the transfer of the formant parameters of the preceding phoneme "i" is continued with the formant levels thereof fixed to values assumed at the start of the key-off. Since the preceding phoneme "i" has started to be damped, the program then proceeds from the step SP403 to the step SP404, wherein it is determined whether or not the level of the phoneme "i" has been sufficiently damped. During this processing, the damping of the phoneme is being carried out by the use of the EG2 as described hereinbefore with reference to FIG. 16B. When the phoneme "i" has been sufficiently damped, the program proceeds to the step SP405, wherein the formant levels of the formant parameters for the channels DAMPCH used for sounding the phoneme "i" are set to "0", and at the step SP406 the damping flag DAMPFLG is set to "0". Even when the damping of the phoneme "i" is being carried out, the transfer of the parameters at the step SP402 is continually executed at time intervals of 5 milliseconds, and when the damping of the phoneme mill is progressed to a certain degree, the transfer of the formant parameters for sounding the "t<02>a<00>" to the formant channels TGCH is executed. Thus, smooth and quick damping of the phoneme "i" by the EG and sounding of the following phonemes "ta" are realized.

Figure 25A:
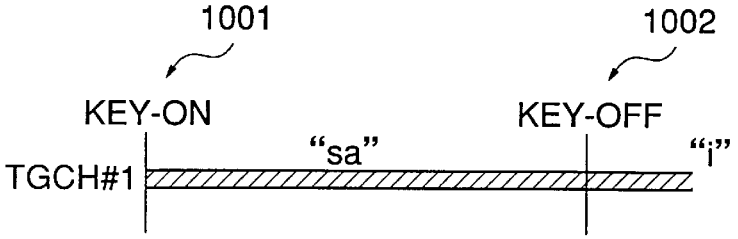
FIGS. 25A to 25C are diagrams showing changes in the formant level which take place when phonemes "sai" are generated by a tone generator appearing in FIG. 15.
Figure 25B:
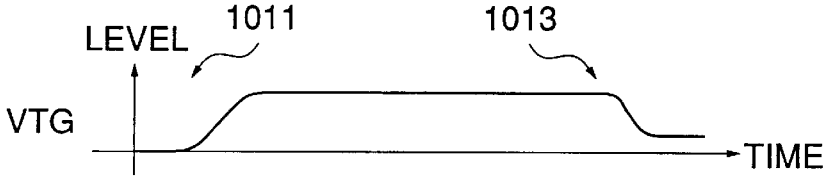
Figure 25C:
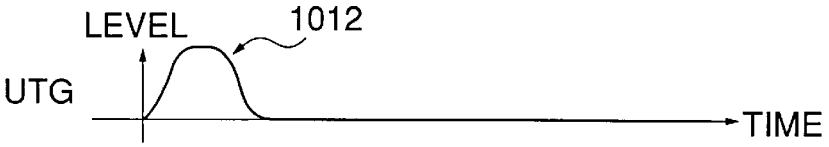
Figure 26A:
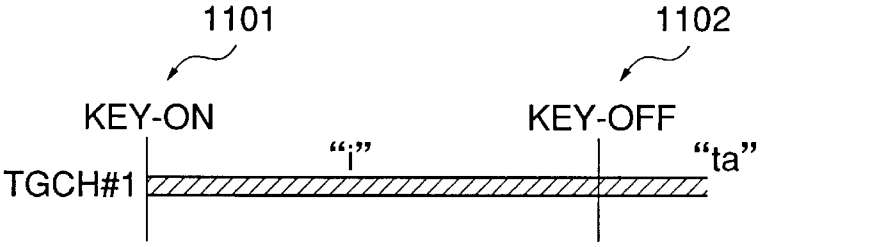
FIG.26A PRIOR ART
FIGS. 26A to 26E are diagrams showing an example of a conventional method of generating a sound of phonemes "ita" in a manner continuously shifting from a phoneme "i" to phonemes "ta"
Figure 26B:
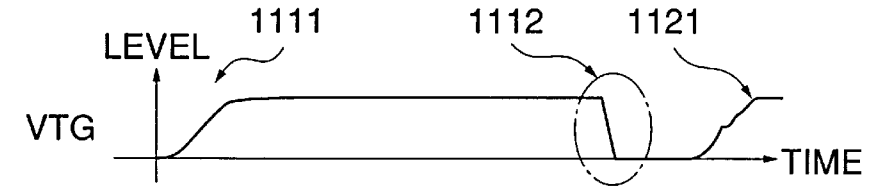
FIG.26B PRIOR ART
Figure 26C:
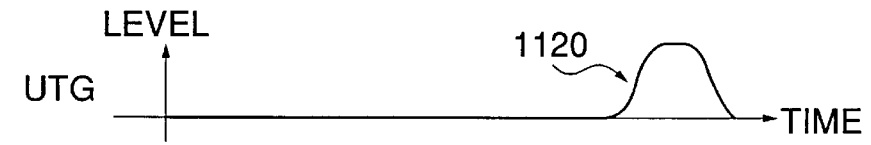
FIG.26C PRIOR ART
Figure 26D:
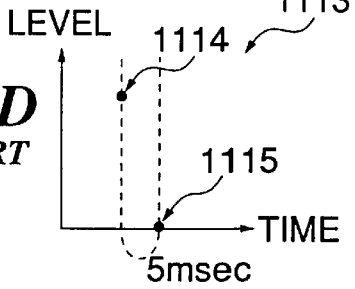
FIG.26D PRIOR ART
Figure 26E:
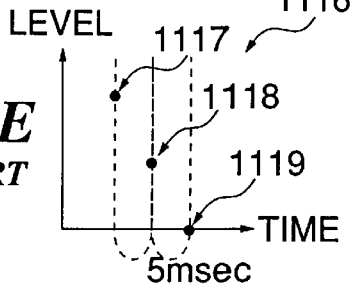
FIG.26E PRIOR ART
Figures 27A, 27B, 27C, 27D, 27E:
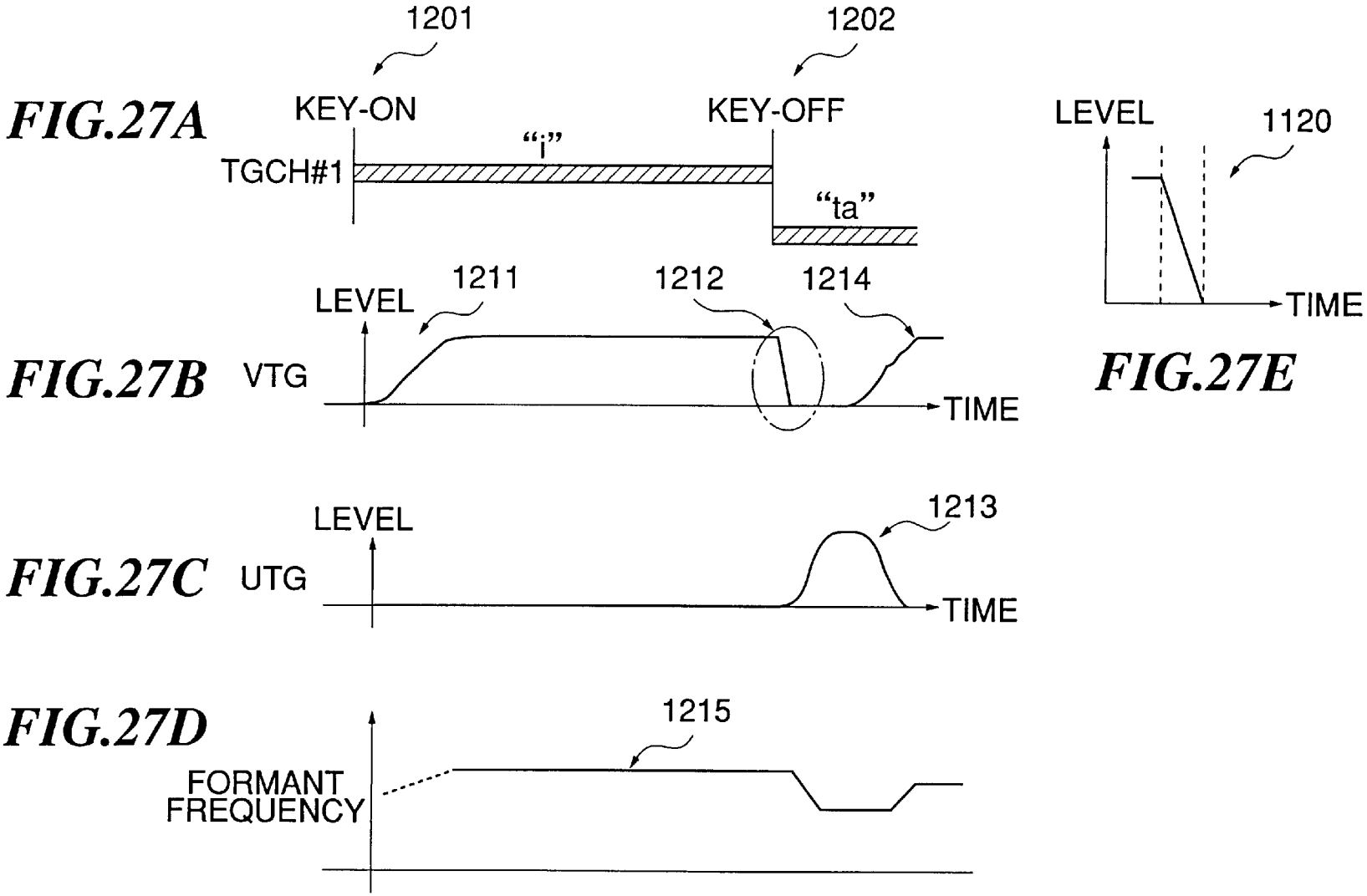
FIGS. 27A to 27E are diagrams showing changes in the formant level which take place when the phonemes "ita" are sounded in a manner continuously shifting from the phoneme "i" to the phonemes "ta" according to the second embodiment of the invention.

FIGS. 25A to 25C show changes in the formant levels of the tone generator units which take place when the phonemes "sai" are sounded. When a key-on event related to the phonemes "sa" is issued at a time point 1001, channels are assigned to the formant channels TGCH for sounding the phonemes "sa". In FIGS. 25A to 25C, VTG designates a formant level of a channel for sounding a voiced sound of the assigned formant channels, and UTG a formant level of a channel for sounding an unvoiced sound of the same (in the illustrated example, the voiced tone generator unit group and the unvoiced tone generator unit group are each represented by one channel). In response to the key-on signal for the phonemes "sa", the formant levels as indicated by 1011 and 1012 are sent from the CPU 101 to the formant channels TGCH at time intervals of 5 milliseconds to thereby start sounding of the phonemes "sa". Then, when a key-on event related to the phoneme "i" is issued, a transition from the phoneme "a" to the phoneme "i", i.e. a transition from a voiced sound to a voiced sound, is executed by the same formant channels through interpolation in a continuous manner, as indicated by 1013.

FIGS. 26A to 26E show an example of transition from the phoneme "i" to the phonemes "tall executed for coarticulation, according to the conventional method. At a time point 1101, a key-on event related to the phoneme "i" is issued, and formant levels of the phoneme are sent to the formant channels TGCH as indicated by 1111 for sounding the phoneme "i". Then, if a key-on event related to the phonemes "ta" is received at a time point 1102, according to the conventional method, a fall portion 1112 of the format level of the phoneme in each channel of the voiced sound tone generator is realized by suddenly dropping the formant level from 1114 to 1115 at time intervals of 5 milliseconds as indicated by 1113, or by sending a somewhat larger number of samples 1117 to 1119 as indicated by 1116. The two methods, which both send the formant levels at time intervals of 5 milliseconds, suffer from the inconvenience that a noise occurs due to a discontinuity in the generator waveform resulting from the fall portion 1112 of the voiced sound or a fall in the formant level cannot be effected quickly. Generation of an unvoiced portion and a voiced portion of the phonemes "ta" is started after the above fall of the level of the phoneme 37 i" as indicated by 1120 and 1121.

FIGS. 27A to 27E show changes in the formant levels according to the present embodiment in which a transition from the phoneme "i" to the phonemes "ta" is effected in a continuous manner. At a time point 1201, a key-on event related to the phoneme "i" is issued, and formant levels are sent to the formant channels TGCH as indicated by 1211 for sounding the phoneme "i". When a key-on event related to the phonemes "ta" is received at a time point 1202, fall of the formant level in each channel of the VTG group for sounding a voiced sound is controlled by the EG 214 according to an envelope waveform delivered at time intervals of the sampling repetition period as indicated by 1220 to obtain a fall portion 1212. After the fall, generation of an unvoiced portion and a voiced portion of the phonemes "ta" is started as indicated by 1213 and 1214. The formant frequency is continuously changed as indicated by 1215.

According to the above described embodiment, even if the capacity of the CPU is small, fall of the formant level is realized by the EG. As a result, even a transition from a voiced sound to an unvoiced sound can be smoothly carried out without noise by the use of a control system having a low data transfer rate.

Figure 23:
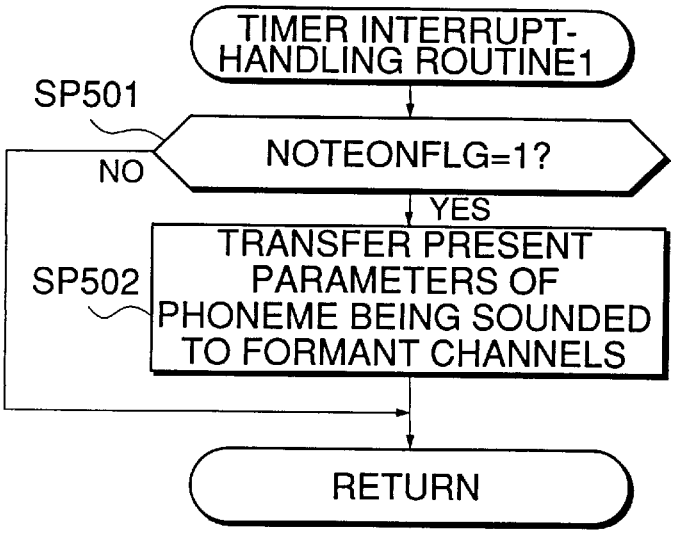
FIG. 23 is a flowchart showing a timer interrupt-handling routine 1 of a variation of the FIG. 22 routine.
Figure 24:
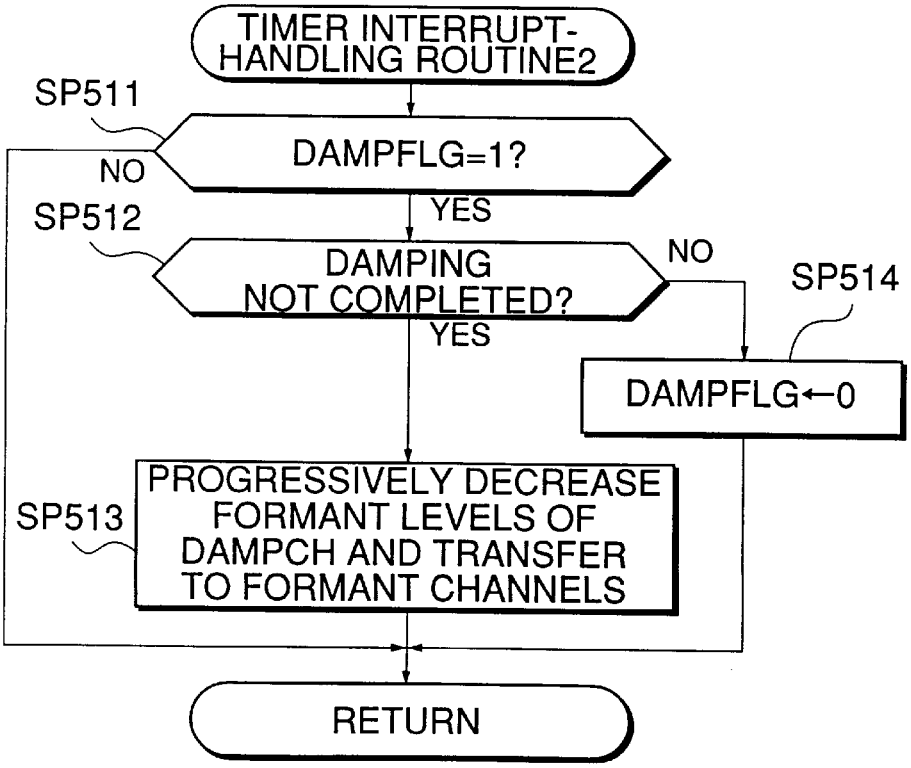
FIG. 24 is a diagram showing a timer interrupt-handling routine 2 of the variation.

FIGS. 23 and 24 show a variation of the routines of FIGS. 19 to 22 of the above described second embodiment. In this variation, the timer interrupt-handling routine shown in FIG. 22 of the second embodiment is carried out in a divided manner, i.e. by a timer interrupt-handling routine 1 shown in FIG. 23 and a timer interrupt-handling routine 2 shown in FIG. 24. The other portions of the routines are assumed to be identical with those described as to the second embodiment. In this variation, the damping of phonemes is not effected by the use of the EG, but by sending formant levels from the CPU 101 to the tone generator at a faster rate. Therefore, the damping functions by the EG described with reference to FIG. 16A to 16C are dispensed with in this variation.

The timer interrupt-handling routine of FIG. 23 is executed at time intervals of 5 milliseconds. At a step SP501, it is determined whether or not the note-on flag NOTEONFLG assumes "1". If it is determined at the step SP501 that the note-on flag NOTEONFLG does not assume "1", it means that no phoneme is being sounded, so that the program is immediately terminated, whereas if it is determined that the note-on flag NOTEONFLG assumes "1", the program proceeds to a step SP502, wherein formant parameters of the phoneme being sounded at the present time point are calculated and sent to the formant channels TGCH. This is the same processing as that executed at the step SP402 in FIG. 22.

The timer interrupt-handling routine of FIG. 24 is executed at time intervals much shorter than 5 milliseconds. At a step SP511, it is determined whether or not the damping flag DAMPFLG assumes "1". If the damping flag DAMPFLG does not assume "1", the program is immediately terminated, whereas if the damping flag DAMPFLG assumes "1", it means that the phoneme being sounded is being damped, and then, at a step SP512, it is determined whether or not the phoneme being damped has been sufficiently damped or attenuated. If the damping has not been completed, the formant levels for the channels DAMPCH on which the phoneme is being damped are progressively decreased and sent to the channels DAMPCH. This realizes a fall of the formant level, which is as smooth as a fall obtained by the EG of the second embodiment. If it is determined at the step SP512 that the damping has been completed, the damping flag DAMPFLG is set to "0" at a step SP514, followed by terminating the program.

According to the above variation, the CPU is required to have a high capacity. The fall of the formant level is realized, however, without the use of the EG, and therefore it is possible to obtain a smooth fall in the formant level without noise even when a transition from a voiced sound to an unvoiced sound is carried out.

Although in the above variation, when a transition from an unvoiced sound to a voiced sound is carried out, noise due to a discontinuous waveform is not so conspicuous to the hearing, and therefore the same processing as carried out on a transition from a voiced sound to a voiced sound and a transition from an unvoiced sound to an unvoiced sound is employed for a transition from an unvoiced sound to a voiced sound, this is not limitative, but a transition from an unvoiced sound to a voiced sound may be carried out in the same manner as carried out on a transition from a voiced sound to an unvoiced sound.

Although in the above second embodiment and variation thereof, part or the whole of the formant-synthesizing tone generator 110 may be realized by either hardware or software, or by a combination thereof.

Further, although in the above embodiments, the ROM 7 or 103 is used as a storage medium for storing the programs, this is not limitative, but it goes without saying that the present invention may be realized by a storage medium, such as a CD-ROM and a floppy disk, as software to be executed by personal computers. Further, the invention including the tone generator 4 or 110 may be realized by software, and can be applied not only to electronic musical instruments, but also to amusement apparatuses, such as game machines and karaoke systems.

What is claimed is:

1. A musical sound synthesizer for generating a predetermined singing sound based on performance data, comprising:

a compression device including a processor that determines whether each of a plurality of phonemes forming said predetermined singing sound and each having a rise time and a sounding duration time assigned thereto is a first phoneme to be sounded in accordance with a note-on signal indicative of a note-on of said performance data, and compresses the rise time of said first phoneme along a time axis based on the rise time and the sounding duration time of said first phoneme when said first phoneme is sound in accordance with occurrence of said note-on signal of said performance data.

2. A musical sound synthesizer according to claim 1, wherein said note-on signal of said performance data is a note-on signal indicative of a note-on of an instrument sound.

3. A musical sound synthesizer for generating a predetermined singing sound based on performance data, comprising:

a storage device that stores a rise time of each of a plurality of phonemes forming said singing sound and a rise characteristic of said each of said phonemes within said rise time;

a first determining device that determines whether or not said rise time of said each of said phonemes is equal to or shorter than a sounding duration time assigned to said each of said phonemes when said each of said phonemes is to be sounded;

a second determining device that determines whether or not said each of said phonemes is a first phoneme to be sounded in accordance with a note-on signal indicative of a note-on of said performance data; and a compression device that compresses said rise characteristic of said each of said phonemes along a time axis, based on results of said determinations of said first determining device and said second determining device.

4. A musical sound synthesizer according to claim 3, wherein said note-on signal of said performance data is a note-on signal indicative of a note-on of an instrument sound.

5. A musical sound synthesizer according to claim 3, wherein when said first determining device determines that said rise time of said each of said phonemes is equal to or shorter than said sounding duration time assigned to said each of said phoneme, said compression device sets said rise time to said sounding duration time.

6. A musical sound synthesizer according to claim 3, wherein said compression device compresses said rise characteristic of said each of said phonemes along said time axis when said second determining device determines that said each of said phonemes is said first phoneme to be sounded in accordance with said note-on signal of said performance data.

7. A musical sound synthesizer for generating a predetermined singing sound based on performance data, comprising:

a storage device that stores a plurality of phonemes forming said predetermined singing sound, and a sounding duration time assigned to said each of said phonemes;

a sounding-continuing device that, when said storage device stores a predetermined value indicative of a sounding duration time assigned to a last phoneme of said phonemes, which is to be sounded last, causes said last phoneme of said phonemes to continue to be sounded until a note-signal indicative of a note-on of said performance data is generated next time; and a sounding-interrupting device that, when said plurality of phonemes include an intermediate phoneme other than said last phoneme, to which said predetermined value is assigned as said sounding duration time stored in said storage device, stops sounding of said intermediate phoneme in accordance with occurrence of a note-off signal indicative of a note-off of said performance data, and thereafter causes a phoneme following said intermediate phoneme to be sounded.

8. A machine readable storage medium containing instructions for causing said machine to perform a musical sound synthesizing method of generating a predetermined singing sound based on performance data, said method comprising the steps of:

determining whether each of a plurality of phonemes forming said predetermined singing sound and each having a rise time and a sounding duration time assigned thereto is a first phoneme to be sounded in accordance with a note-on signal indicative of a note-on of said performance data; and compressing the rise time of said first phoneme along a time axis based on the rise time and the sounding duration time of said first phoneme when said first phoneme is sounded in accordance with occurrence of said note-on signal of said performance data.

9. A musical sound synthesizer comprising:

a plurality of tone generator channels to which are input formant parameters externally supplied at time intervals longer than a sampling repetition period, said tone generator channels generating a voiced sound waveform and an unvoiced sound waveform having formants formed based on said formant parameters and outputting said voiced sound waveform and said unvoiced sound waveform at said sampling repetition time period;

an envelope generator that forms an envelope waveform and outputs said envelope waveform at said sampling repetition period;

a detecting device that detects whether switching of phonemes to be sounded is to be carried out between phonemes of voiced sounds or between phonemes of unvoiced sounds; and a control device that generates a musical sound according to said formant parameters supplied at said time intervals by the use of ones of said tone generator channels used before said switching of phonemes to be sounded, when said detecting device detects that said switching of phonemes to be sounded is to be carried out between said phonemes of voiced sounds or between said phonemes of unvoiced sounds, said control device decreasing formant levels of said formant parameters of a preceding one of said phonemes to be sounded by the use of said envelope waveform output from said envelope generator at said sampling repetition period to generate a sound of a following one of said phonemes to be sounded, by switching over said tone generator channels, when said detecting device detects that said switching of said phonemes to be sounded is to be carried out between phonemes other than said phonemes of voiced sounds or said phonemes of unvoiced sounds and at the same time said formant levels of said formant parameters of said preceding one of said phonemes to be sounded are to be decreased in a short time period depending on relationship between said preceding one of said phonemes to be sounded and said following one of said phonemes to be sounded.

10. A musical sound synthesizer comprising:

a plurality of tone generator channels to which are input formant parameters externally supplied at time intervals longer than a sampling repetition period, said tone generator channels generating a voiced sound waveform and an unvoiced sound waveform having formants formed based on said formant parameters and outputting said voiced sound waveform and said unvoiced sound waveform at said sampling repetition time period;

an envelope generator that forms an envelope waveform and outputs said envelope waveform at said sampling repetition period;

a detecting device that detects whether switching of phonemes to be sounded is to be carried out between phonemes of voiced sounds or between phonemes of unvoiced sounds; and a control device that shifts a phoneme to be sounded from a preceding one of said phonemes to be sounded to a following one of said phonemes to be sounded by inputting formant parameters obtained by interpolating said formant parameters between said preceding one of said phonemes to be sounded and said following one of said phonemes to be sounded, at said time intervals, to identical ones of said tone generator channels with ones used for sounding said preceding one of said phonemes to be sounded, when said detecting device detects that said switching of said phonemes to be sounded is to be carried out between said phonemes of voiced sounds or between said phonemes of unvoiced sounds, said control device decreasing formant levels of said formant parameters of said preceding one of said phonemes to be sounded by the use of said envelope waveform output from said envelope generator at said sampling repetition period, and starting sounding said following one of said phonemes to be sounded by the use of other ones of said tone generator channels than said ones used for sounding said preceding one of said phonemes to be sounded, when said detecting device detects that said switching of said phonemes to be sounded is to be carried out between phonemes other than said phonemes of voiced sounds or said phonemes of unvoiced sounds and at the same time said formant levels of said formant parameters of said preceding one of said phonemes to be sounded are to be decreased in a short time period depending on relationship between said preceding one of said phonemes to be sounded and said following one of said phonemes to be sounded.

11. A musical sound synthesizer comprising:

a formant parameter-sending device that sends formant parameters at time intervals longer than a sampling repetition time period, said formant parameter-sending device having a function of interpolating said formant parameters between a preceding one of phonemes to be sounded and a following one of said phonemes to be sounded and sending said formant parameters obtained by the interpolation;

a plurality of tone generator channels that generate a voiced sound waveform and an unvoiced sound waveform having formants formed based on said formant parameters sent from said formant parameter-sending device, and output said voiced sound waveform and said unvoiced sound waveform at said sampling repetition time period;

an envelope generator that forms an envelope waveform and outputs said envelope waveform at said sampling repetition period;

a detecting device that detects whether switching of said phonemes to be sounded is to be carried out between phonemes of voiced sounds or between phonemes of unvoiced sounds; and a control device that shifts a phoneme to be sounded from said preceding one of said phonemes to be sounded to said following one of said phonemes to be sounded by causing said formant parameter-sending device to send said formant parameters obtained by the interpolation between said preceding one of said phonemes to be sounded and said following one of said phonemes to be sounded, to said tone generator channels at said time intervals, when said detecting device detects that said switching of said phonemes to be sounded is to be carried out between said phonemes of voiced sounds or between said phonemes of unvoiced sounds, said control device decreasing formant levels of said formant parameters of said preceding one of said phonemes to be sounded by the use of said envelope waveform output from said envelope generator at said sampling repetition period, and starting sounding said following one of said phonemes to be sounded by the use of other ones of said tone generator channels than ones used for sounding said preceding one of said phonemes to be sounded, when said detecting device detects that said switching of said phonemes to be sounded is to be carried out between phonemes other than said phonemes of voiced sounds or said phonemes of unvoiced sounds and at the same time said formant levels of said formant parameters of said preceding one of said phonemes to be sounded are to be decreased in a short time period depending on relationship between said preceding one of said phonemes to be sounded and said following one of said phonemes to be sounded.

12. A musical sound synthesizer comprising:

a formant parameter-sending device that sends formant parameters at time intervals longer than a sampling repetition time period, said formant parameter-sending device having a function of interpolating said formant parameters between a preceding one of phonemes to be sounded and a following one of said phonemes to be sounded and sending said formant parameters obtained by the interpolation;

a plurality of first tone generator channels that generate a voiced sound waveform having formants formed based on said formant parameters sent from said formant parameter-sending device and output said voiced sound waveform at said sampling repetition time period;

an envelope generator that forms an envelope waveform which rises from a level of 0 to a level of 1 in accordance with a key-on signal, holds said level of 1 during said key-on, and falls at a predetermined release rate in accordance with a key-off signal, and outputs said envelope waveform at said sampling repetition period;

a formant level control device that controls formant levels of said voiced sound waveform output from said first tone generator channels, based on said envelope waveform output from said envelope generator and formant levels of said formant parameters sent from said formant parameter-sending device;

a plurality of second tone generator channels that generate an unvoiced sound waveform having formants formed based on said formant parameters sent from said formant parameter-sending device and output said unvoiced sound waveform at said sampling repetition time period;

a mixing device that mixes said voiced sound waveform controlled in respect of said formant levels by said formant level control device and said unvoiced sound waveform output from said second tone generator channels;

a detecting device that detects whether switching of said phonemes to be sounded is to be carried out between phonemes of voiced sounds or between phonemes of unvoiced sounds; and a control device that:

(i) shifts a phoneme to be sounded from said preceding one of said phonemes to be sounded to said following one of said phonemes to be sounded by using ones of said first or second tone generator channels used for sounding said preceding phoneme of said phonemes to be sounded and causing said formant parameter-sending device to send said formant parameters obtained by the interpolation between said preceding one of said phonemes to be sounded and said following one of said phonemes to be sounded, to said ones of said first or second tone generator channels at said time intervals, when said detecting device detects that said switching of said phonemes to be sounded is to be carried out between said phonemes of voiced sounds or between said phonemes of unvoiced sounds; and (ii) sends said key-off signal for said preceding one of said phonemes to be sounded to thereby decrease a formant level of each of said formants of said voiced sound waveform output from ones of said first tone generator channels used for sounding said preceding one of said phonemes to be sounded, by the use of said envelope waveform output from said envelope generator at said sampling repetition period, and at the same time starts sounding said following one of said phonemes to be sounded by the use of other ones of said first tone generator channels than ones used for sounding said preceding one of said phonemes to be sounded, when said detecting device detects that said switching of said phonemes to be sounded is to be carried out from a phoneme of a voiced sound to a phoneme of an unvoiced sound.

13. A musical sound synthesizer comprising:

a formant parameter-sending device that sends formant parameters at first time intervals longer than a sampling repetition time period, said formant parameter-sending device having a function of interpolating said formant parameters between a preceding one of phonemes to be sounded and a following one of phonemes to be sounded and sending said formant parameters obtained by the interpolation;

a formant level-sending device that sends only formant levels out of said formant parameters at second time intervals shorter than said first time intervals;

a plurality of tone generator channels that generate a voiced sound waveform and an unvoiced sound waveform each having formants formed based on said formant parameters sent from said formant parameter-sen ding device at said first time intervals, and output said voiced sound waveform and said unvoiced sound waveform, said tone generator channels generating a waveform having formant levels thereof controlled by said formant levels sent from said formant level-sending device at said second time intervals and outputting said waveform;

a detecting device that detects whether switching of phonemes to be sounded is to be carried out between phonemes of voiced sounds or between phonemes of unvoiced sounds; and a control device that (i) shifts a phoneme to be sounded from said preceding one of said phonemes to be sounded to said following one of said phonemes to be sounded by using ones of said tone generator channels used for sounding said preceding phoneme of said phonemes to be sounded and causing said formant parameter-sending device to send said formant parameters obtained by the interpolation between said preceding one of said phonemes to be sounded and said following one of said phonemes to be sounded, to said ones of said tone generator channels at said first time intervals, when said detecting device detects that said switching of said phonemes to be sounded is to be carried out between said phonemes of voiced sounds or between said phonemes of unvoiced sounds; and (ii) causes said formant level-sending device to send formant levels which quickly and smoothly fall at said second time intervals, to thereby decrease said formant levels of said preceding one of said phonemes to be sounded, when said detecting device detects that switching of said phonemes to be sounded is to be carried out between phonemes other than said phonemes of voiced sounds or said phonemes of unvoiced sounds and at the same time said formant levels of said formant parameters of said preceding one of said phonemes to be sounded are to be decreased, in a short time period depending on relationship between said preceding one of said phonemes to be sounded and said following one of said phonemes to be sounded, and at the same time starts sounding said following one of said phonemes to be sounded by the use of other ones of said tone generator channels than said ones of said tone generator channels used for sounding said preceding one of said phonemes to be sounded.

14. A machine readable storage medium containing instructions for causing said machine to perform a musical sound synthesizing method of synthesizing a musical sound by the use of a plurality of tone generator channels to which are input formant parameters externally supplied at time intervals longer than a sampling repetition period, said tone generator channels generating a voiced sound waveform and an unvoiced sound waveform having formants formed based on said formant parameters and outputting said voiced sound waveform and said unvoiced sound waveform at said sampling repetition time period, said method comprising the steps of:

forming an envelope waveform and outputting said envelope waveform at said sampling repetition period;

detecting whether switching of phonemes to be sounded is to be carried out between phonemes of voiced sounds or between phonemes of unvoiced sounds; and generating a musical sound according to said formant parameters supplied at said time intervals by the use of ones of said tone generator channels used before said switching of phonemes to be sounded, when it is detected that said switching of phonemes to be sounded is to be carried out between said phonemes of voiced sounds or between said phonemes of unvoiced sounds, and decreasing formant levels of said formant parameters of a preceding one of said phonemes to be sounded by the use of said envelope waveform output at said sampling repetition period to generate a sound of a following one of said phonemes to be sounded by switching over said tone generator channels, when it is detected that said switching of said phonemes to be sounded is to be carried out between phonemes other than said phonemes of voiced sounds or said phonemes of unvoiced sounds and at the same time said formant levels of said formant parameters of said preceding one of said phonemes to be sounded is to be decreased in a short time period depending on relationship between said preceding one of said phonemes to be sounded and said following one of said phonemes to be sounded.

15. A musical sound synthesizer for generating a predetermined singing sound based on performance data, comprising:

means for determining whether each of a plurality of phonemes forming said predetermined singing sound and each having a rise time and a sounding duration time assigned thereto is a first phoneme to be sounded in accordance with a note-on signal indicative of a note-on of said performance data; and means for compressing the rise time of said first phoneme along a time axis based on the rise time and the sounding duration time of said first phoneme when said first phoneme is sounded in accordance with occurrence of said note-on signal of said performance data.

16. A musical sound synthesizing method of generating a predetermined singing sound based on performance data, said method comprising the steps of:

determining whether each of a plurality of phonemes forming said predetermined singing sound and each having a rise time and a sounding duration time assigned thereto is a first phoneme to be sounded in accordance with a note-on signal indicative of a note-on of said performance data; and compressing the rise time of said first phoneme along a time axis based on the rise time and the sounding duration time of said first phoneme when said first phoneme is sounded in accordance with occurrence of said note-on signal of said performance data.

17. A musical sound synthesizer for synthesizing a musical sound by the use of a plurality of tone generator channels to which are input formant parameters externally supplied at time intervals longer than a sampling repetition period, said tone generator channels generating a voiced sound waveform and an unvoiced sound waveform having formants formed based on said formant parameters and outputting said voiced sound waveform and said unvoiced sound waveform at said sampling repetition time period, said musical sound synthesizer comprising:

means for forming an envelope waveform and outputting said envelope waveform at said sampling repetition period;

means for detecting whether switching of phonemes to be sounded is to be carried out between phonemes of voiced sounds or between phonemes of unvoiced sounds; and means for generating a musical sound according to said formant parameters supplied at said time intervals by the use of ones of said tone generator channels used before said switching of phonemes to be sounded, when it is detected that said switching of phonemes to be sounded is to be carried out between said phonemes of voiced sounds or between said phonemes of unvoiced sounds, and decreasing formant levels of said formant parameters of a preceding one of said phonemes to be sounded by the use of said envelope waveform output at said sampling repetition period to generate a sound of a following one of said phonemes to be sounded by switching over said tone generator channels, when it is detected that said switching of said phonemes to be sounded is to be carried out between phonemes other than said phonemes of voiced sounds or said phonemes of unvoiced sounds and at the same time said formant levels of said formant parameters of said preceding one of said phonemes to be sounded is to be decreased in a short time period depending on relationship between said preceding one of said phonemes to be sounded and said following one of said phonemes to be sounded.

18. A musical sound synthesizing method of synthesizing a musical sound by the use of a plurality of tone generator channels to which are input formant parameters externally supplied at time intervals longer than a sampling repetition period, said tone generator channels generating a voiced sound waveform and an unvoiced sound waveform having formants formed based on said formant parameters and outputting said voiced sound waveform and said unvoiced sound waveform at said sampling repetition time period, said method comprising the steps of:

forming an envelope waveform and outputting said envelope waveform at said sampling repetition period;

detecting whether switching of phonemes to be sounded is to be carried out between phonemes of voiced sounds or between phonemes of unvoiced sounds; and generating a musical sound according to said formant parameters supplied at said time intervals by the use of ones of said tone generator channels used before said switching of phonemes to be sounded, when it is detected that said switching of phonemes to be sounded is to be carried out between said phonemes of voiced sounds or between said phonemes of unvoiced sounds, and decreasing formant levels of said formant parameters of a preceding one of said phonemes to be sounded by the use of said envelope waveform output at said sampling repetition period to generate a sound of a following one of said phonemes to be sounded by switching over said tone generator channels, when it is detected that said switching of said phonemes to be sounded is to be carried out between phonemes other than said phonemes of voiced sounds or said phonemes of unvoiced sounds and at the same time said formant levels of said formant parameters of said preceding one of said phonemes to be sounded is to be decreased in a short time period depending on relationship between said preceding one of said phonemes to be sounded and said following one of said phonemes to be sounded.

* * * * *